US012650073B1

(12) United States Patent
Santos et al.

(10) Patent No.: US 12,650,073 B1
(45) Date of Patent: Jun. 9, 2026

(54) COMPLIANCE ENFORCEMENT OF SAFETY PROTOCOLS ON DRILLING RIGS

(71) Applicant: SAFEKICK AMERICAS LLC, Katy, TX (US)

(72) Inventors: Helio Santos, Reading (GB); Jason Hannam, Fulshear, TX (US); James Regan, São Jose Dos Campos (BR)

(73) Assignee: SAFEKICK AMERICAS LLC, Katy, TX (US)

( * ) Notice: Subject to any disclaimer, the term of this patent is extended or adjusted under 35 U.S.C. 154(b) by 0 days.

(21) Appl. No.: 19/353,060

(22) Filed: Oct. 8, 2025

Related U.S. Application Data

(63) Continuation of application No. PCT/US2025/028829, filed on May 12, 2025.

(51) Int. Cl.
*E21B 47/06* (2012.01)
*E21B 47/117* (2012.01)

(52) U.S. Cl.
CPC ..... *E21B 47/06* (2013.01); *E21B 47/117* (2020.05)

(58) Field of Classification Search
CPC ..... E21B 33/06; E21B 47/117; E21B 47/06
See application file for complete search history.

(56) References Cited

U.S. PATENT DOCUMENTS

2019/0339156 A1 11/2019 Hilpert et al.
2019/0368337 A1* 12/2019 Maresca, Jr. ..... E21B 47/117
2020/0217745 A1 7/2020 Hilpert et al.
2023/0243350 A1 8/2023 Kabrich et al.
2024/0060843 A1 2/2024 Dormody et al.
2024/0060849 A1 2/2024 Hirata et al.
2024/0419197 A1 12/2024 Fink et al.

FOREIGN PATENT DOCUMENTS

CA 3141023 A1 * 1/2021 ..... E21B 47/06

OTHER PUBLICATIONS

Industrial Physics. Pressure Decay Leak Testers. Mar. 31, 2022 (Mar. 31, 2022) [retrieved on Jul. 15, 2025]. Retrieved from the internet entire document.

(Continued)

*Primary Examiner* — Zakiya W Bates
(74) *Attorney, Agent, or Firm* — Basil M. Angelo; ANGELO IP

(57) ABSTRACT

Compliance enforcement of safety protocols on a drilling rig includes receiving a pressure test procedure including a pressure test for one or more pressure-keeping devices under test and a specific configuration of equipment involved in the pressure test, validating the pressure test procedure by determining that the specific configuration of equipment, as implemented on the drilling rig, is capable of isolating and pressurizing the one or more pressure-keeping devices under test, receiving a current alignment for each of one or more valves required to isolate and pressurize one or more pressure-keeping devices under test, where each of the one or more valves communicates its current alignment to the computing system, and validating the current alignment for each of the one or more valves is capable of isolating and pressurizing the one or more pressure-keeping devices under test in accordance with the pressure test.

47 Claims, 13 Drawing Sheets

(56) References Cited

OTHER PUBLICATIONS

Scott Laboratories. Pressure Hold Integrity Testing. Mar. 31, 2024 (Mar. 31, 2024) [retrieved on Jul. 15, 2025]. Retrieved from the internet entire document.
WIPO PCT International Search Report of International Search Authority (USPTO) issued in PCT Int'l Application PCT/US2025/028829, filed May 12, 2025, mailed Jul. 28, 2025.
WIPO PCT Written Opinion of International Search Authority (USPTO) issued in PCT Int'l Application PCT/US2025/028829, filed May 12, 2025, mailed on Jul. 28, 2025.

* cited by examiner

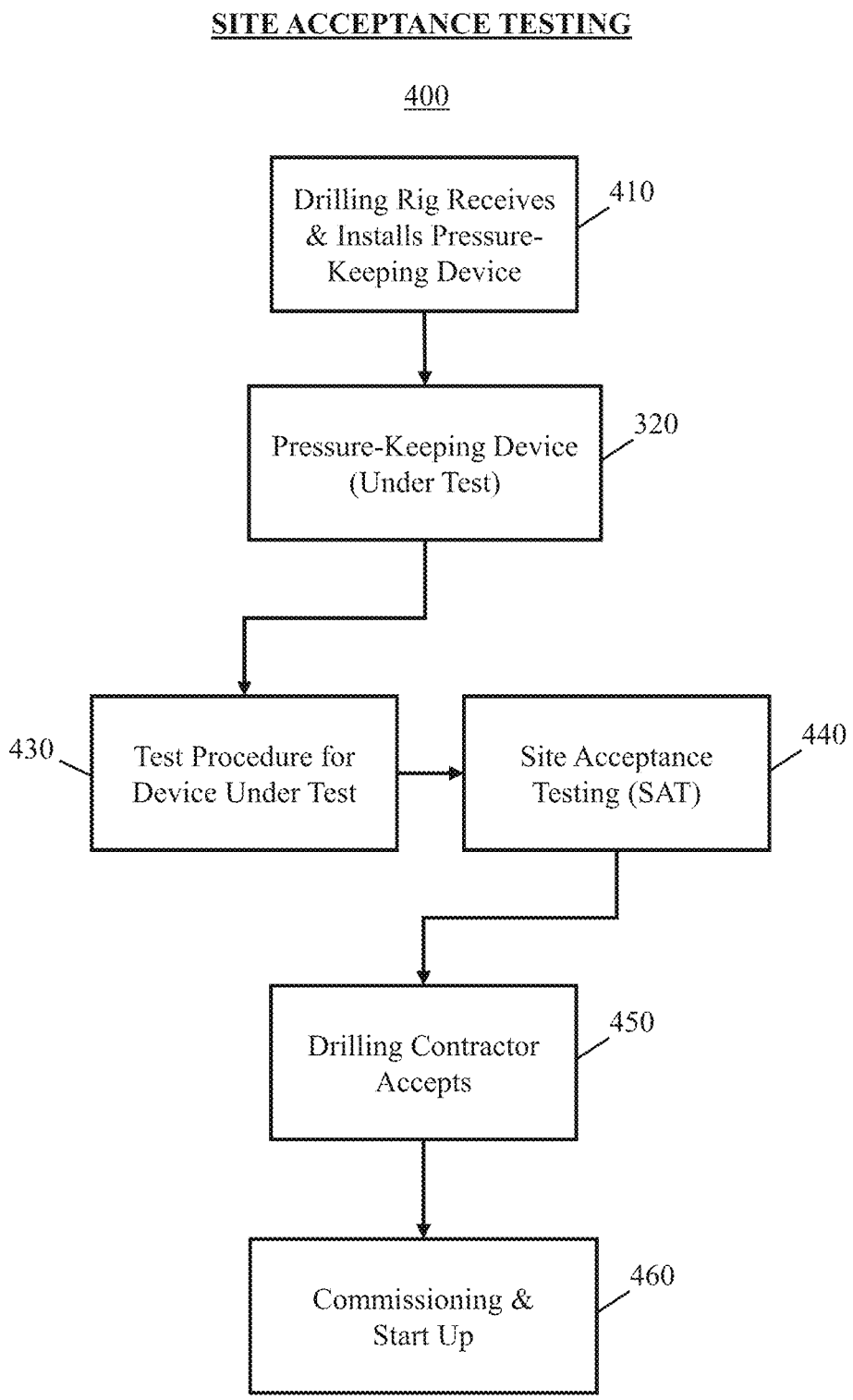
FIG. 3B
PRIOR ART

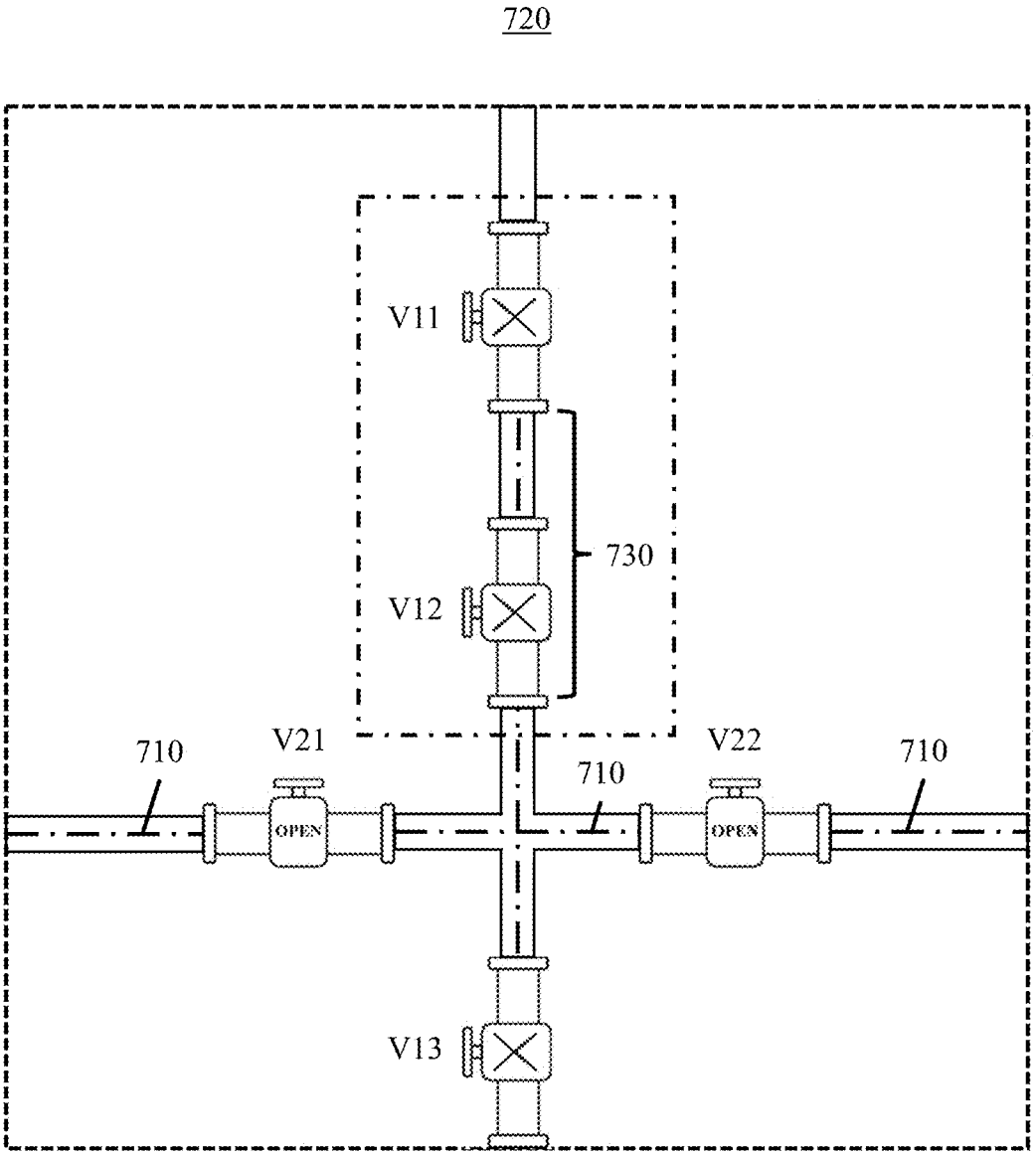
FIG. 4B

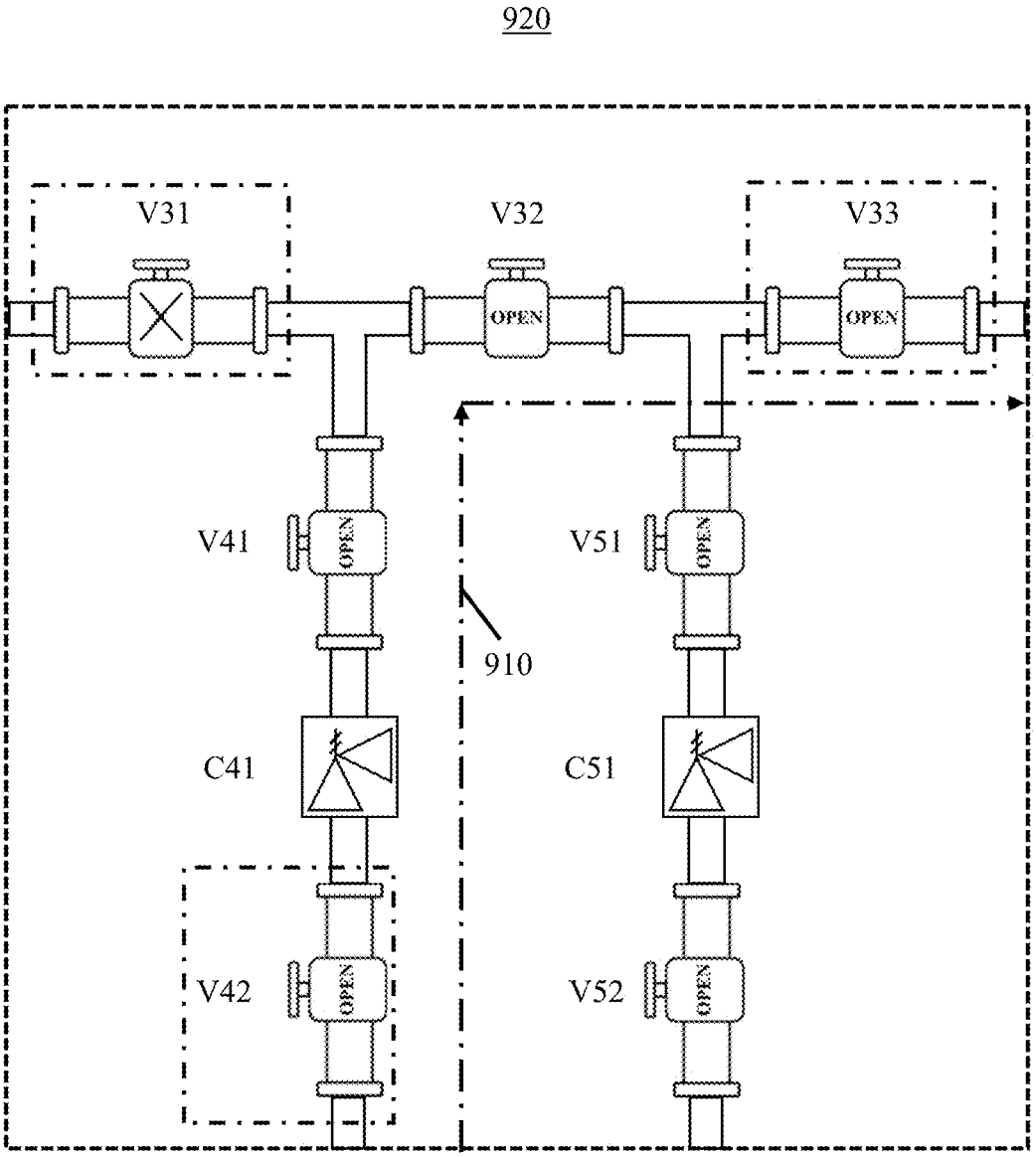
FIG. 6B

COMPLIANCE ENFORCEMENT OF SAFETY PROTOCOLS ON DRILLING RIGS

CROSS REFERENCE TO RELATED APPLICATIONS

This application is a continuation of PCT International Application PCT/US2025/028829, filed on May 12, 2025, which is hereby incorporated by reference in its entirety.

BACKGROUND OF THE INVENTION

The proper function of pressure-keeping devices is critical for ensuring the safety of rig personnel, the drilling rig, and the greater well system, maintaining the structural integrity of the wellbore, and safeguarding the environment from contamination. The well system includes, but is not limited to, the casings and cement that line the wellbore, the wellhead, the blowout preventer ("BOP"), auxiliary lines, the marine riser system, mud circulating system, annular sealing system, annular closing system, flow diverter, Managed Pressure Drilling ("MPD") manifolds, well control choke manifold, standpipe manifold, cement manifold, pressure relief valves, hydraulic control systems, and numerous other valves, hoses, and other equipment that are subject to pressurization during operations. The verifiable ability of these essential pressure-keeping devices to maintain pressure in accordance with their specification is critical to ensuring the safety of operations.

In deepwater drilling operations, the proper function of these essential pressure-keeping devices is even more critical due to the challenging and unpredictable nature of the subsea environment. The extreme depths and high pressures encountered pose unique challenges, such as an increased likelihood of blowouts and increased complexity of maintaining well control. Enhanced pressure-keeping devices, like advanced BOPs, safety valves, and high-pressure choke manifolds, are crucial for effectively managing these risks. Precisely controlling wellbore pressure, as well as pressure throughout the greater well system, is essential for preventing catastrophic failures and protecting the safety of the rig personnel on board. In deepwater settings, where the margin for error is significantly reduced, the performance and reliability of pressure-keeping devices are paramount to the safety of operations.

BRIEF SUMMARY OF THE INVENTION

According to one aspect of one or more embodiments of the present invention, a method of compliance enforcement of safety protocols on a drilling rig includes receiving, at the computing system, a pressure test procedure including a pressure test for the one or more pressure-keeping devices under test and a specific configuration of equipment involved in the pressure test, validating, by the computing system, the pressure test procedure by determining that the specific configuration of equipment, as implemented on the drilling rig, is capable of isolating and pressurizing the one or more pressure-keeping devices under test in accordance with the pressure test, receiving, at the computing system, a current alignment for each of one or more valves required to isolate and pressurize one or more pressure-keeping devices under test in accordance with a pressure test, wherein each of the one or more valves communicates its current alignment to the computing system, validating, by the computing system, the current alignment for each of the one or more valves is capable of isolating and pressurizing the one or more pressure-keeping devices under test in accordance with the pressure test, and providing, by the computing system, an indication that the pressure test is safe to execute based on the validation of the pressure test procedure and the current alignment for each of the one or more valves.

According to one aspect of one or more embodiments of the present invention, a non-transitory computer-readable medium comprising software instructions that, when executed by a processor, perform a method of compliance enforcement of safety protocols on a drilling rig includes receiving, at the computing system, a pressure test procedure including a pressure test for the one or more pressure-keeping devices under test and a specific configuration of equipment involved in the pressure test, validating, by the computing system, the pressure test procedure by determining that the specific configuration of equipment, as implemented on the drilling rig, is capable of isolating and pressurizing the one or more pressure-keeping devices under test in accordance with the pressure test, receiving, at the computing system, a current alignment for each of one or more valves required to isolate and pressurize one or more pressure-keeping devices under test in accordance with a pressure test, wherein each of the one or more valves communicates its current alignment to the computing system, validating, by the computing system, the current alignment for each of the one or more valves is capable of isolating and pressurizing the one or more pressure-keeping devices under test in accordance with the pressure test, and providing, by the computing system, an indication that the pressure test is safe to execute based on the validation of the pressure test procedure and the current alignment for each of the one or more valves.

Other aspects of the present invention will be apparent from the following description and claims.

BRIEF DESCRIPTION OF THE DRAWINGS

FIG. 3B shows an exemplary Site Acceptance Testing procedure for the pressure-keeping device under test, performed on the drilling rig.

FIG. 4B shows an undocumented and unreported specific configuration of equipment including the one or more pressure-keeping devices under test after double-valving to hide the failing valve in the pressure flow path.

FIG. 6B shows a graphical display of the validated alignment of the subset valves on the drilling rig as part of the exemplary pressure test in accordance with one or more embodiments of the present invention.

DETAILED DESCRIPTION OF THE INVENTION

Figure 1:
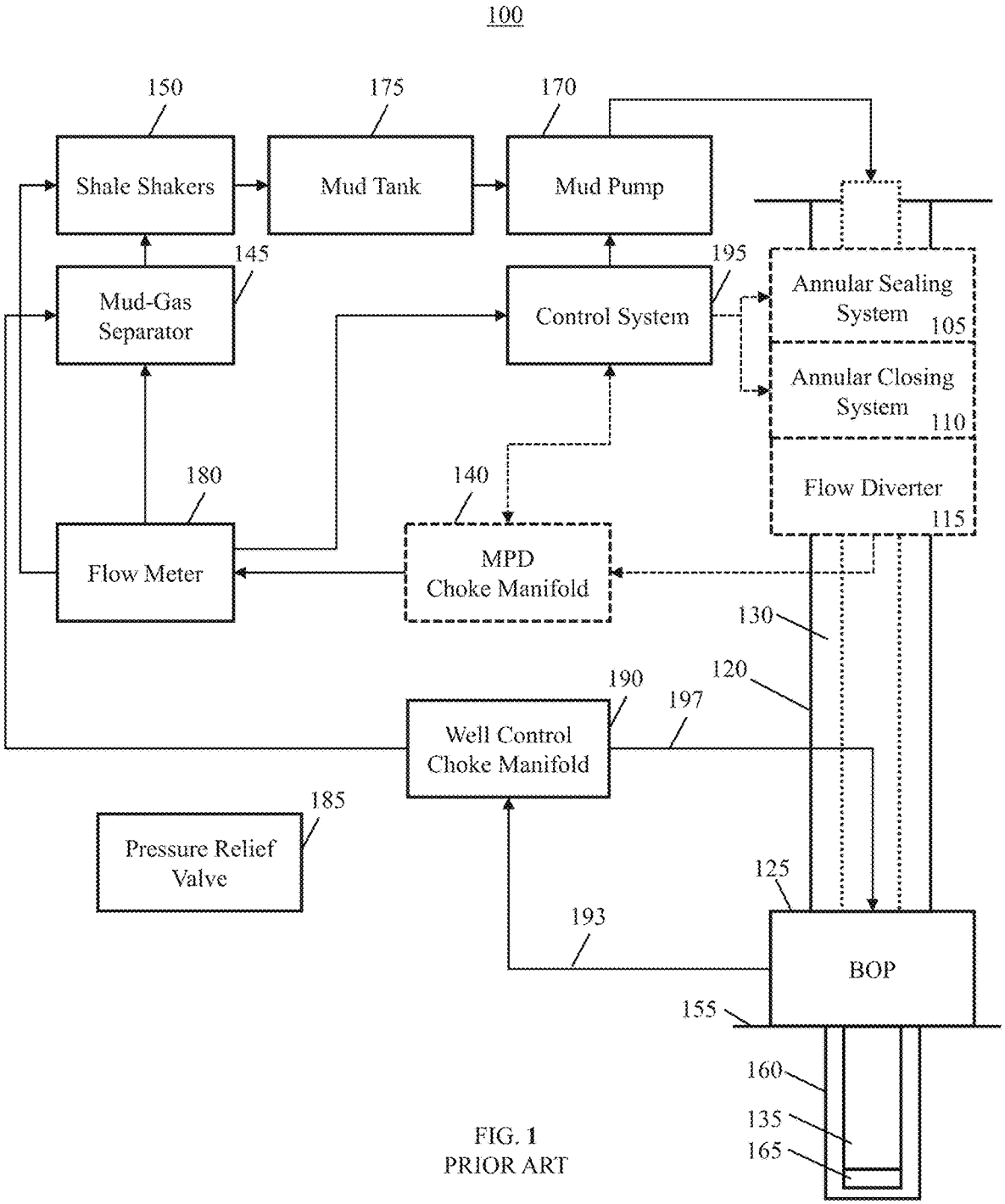
FIG. 1 PRIOR ART
FIG. 1 shows a conventional hydraulic drilling system.

One or more embodiments of the present invention are described in detail with reference to the accompanying figures. For consistency, like elements in the figures are denoted by like reference numerals. In the following detailed description of the present invention, specific details are described to provide a thorough understanding of the present invention. In other instances, aspects that are well-known to those of ordinary skill in the art are not described to avoid obscuring the description of the present invention.

In challenging deepwater and ultra-deepwater drilling environments, the ability to precisely control wellbore pressure, maintain well control, and effectively respond to unexpected contingencies is even more important to the safety of drilling operations. Given the inherent dangers of the offshore environment and isolation from the mainland, safety is paramount. Continually ensuring the proper function of pressure-keeping devices on the drilling rig, within the greater well system, and within the wellbore is essential to the safety of operations.

FIG. 1 shows a conventional hydraulic drilling system 100 for an offshore drilling rig. While the figure depicts an offshore drilling rig that includes a marine riser and optional managed pressure drilling equipment, onshore drilling rigs include substantially the same components (excluding the marine riser), such that the discussion that follows applies with equal force to both onshore and offshore drilling rigs, as well as those that implement managed pressure drilling and those that do not.

The safety of drilling operations relies heavily on effective pressure management. Generally speaking, well control refers to various procedures that are used to maintain pressure within the wellbore during drilling, completion, and production operations. Pragmatically, the objective of well control is to prevent the uncontrolled release of formation fluids, that often include explosive gases, into the well system by balancing the wellbore pressure (including both hydrostatic and dynamic pressures) exerted by the drilling fluid in the wellbore with the formation pressure. If the formation pressure exceeds the pressure in the wellbore, it can lead to an unintentional influx of formation fluids that, if not managed properly, can escalate into a catastrophic blowout. Primary well control techniques seek to avoid this by properly managing the pressure within the wellbore during drilling and other operations. Secondary well control techniques focus on managing well control events where the BOP is closed, such as, for example, circulating out an unintentional influx of formation fluids that contain explosive gases from the well system and controlled well kill operations.

While open-loop hydraulic drilling applications remain in common use, in deepwater and ultra-deepwater applications, the modern trend is toward closed-loop hydraulic drilling systems with optional MPD equipment. In such closed-loop hydraulic drilling applications, the drilling rig may include optional MPD equipment that, as part of primary well control, may be used to maintain wellbore pressure within a safe pressure gradient bound by the pore pressure (or collapse pressure) and the fracture pressure of the formation. The precise management of wellbore pressure within this safe pressure gradient plays an important role in preventing the fracturing of the formation and the corresponding influx of formation fluids during drilling operations, thereby protecting the structural integrity of the wellbore. However, as operators and drilling contractors pursue increasingly challenging well plans, maintaining well control requires the careful navigation of a narrow pressure gradient, that varies with wellbore depth, with very little margin for error. In such complicated operations, contingencies inevitably arise, and the pressure-keeping devices must function properly to protect the safety of the rig personnel, the drilling rig, and the greater well system, as well as protect the environment from contamination.

Drilling system 100 includes, in the case of an offshore application, a marine riser 120 disposed above, and in fluid communication with, BOP 125. BOP 125 is disposed above, and in fluid communication with, a wellhead (not shown) that is disposed above seafloor 155, and in fluid communication with, wellbore 160. BOP 125 may include an upper annular preventer (not shown) and a lower annular preventer (not shown) that form a pressure-tight seal around drill pipe (not shown), a casing (not shown), or an open hole (not shown) as well as ram-type shears (not shown) and other safety devices (not shown). The kill line 197 fluidly connects well control choke manifold 190 disposed on the surface to BOP 125 for the purpose of injecting heavy kill fluids below the annular of BOP 125 during a well control event. Choke line 193 fluidly connects an outlet of BOP 125 to well control choke manifold 190 to take fluid returns during well control operations. The central lumen extends through marine riser system 120, BOP 125, the wellhead (not independently shown), and into wellbore 160 to facilitate drilling and other operations. Drillstring 135 may be disposed through the central lumen and include, on a distal end, drill bit 165 configured to drill wellbore 160. Drilling system 100 may include other components such as, for example, a diverter of last resort (not shown), a ball joint (not shown), and a telescopic joint (not shown) that are typically disposed above the MPD riser joint, which are not shown.

In closed-loop hydraulic drilling applications, drilling system 100 may include an optional MPD riser joint that includes annular scaling system 105, annular closing system 110 disposed below annular sealing system 105, and flow diverter 115 disposed below annular closing system 110. Annular sealing system 105 controllably seals annulus 130 surrounding drillstring 135 such that it is encapsulated and no longer atmospheric. Annular scaling system 105 may be a rotating control device, active control device, or other pressure containment system capable of creating a pressure-tight annular seal such that the wellbore pressure may be managed by the application of surface backpressure. Annular closing system 110 may be a system for maintaining the annular seal when annular closing system 105, or components thereof, are being installed, serviced, or replaced. Flow diverter 115 diverts returning fluids from below the annular seal to MPD choke manifold 140, that directs the fluid returns to the fluids processing systems for recycling and reuse. Flow diverter 115 is disposed above, and in fluid communication with, the lower portion of marine riser 120.

During MPD operations, one or more mud pumps 170 controllably pump drilling fluids (not shown) from mud tank 175 downhole through an interior passageway of drillstring 135. The drilling fluids (not shown) return through annulus 130 surrounding drillstring 135 and are controllably diverted by flow diverter 115 to one or more choke valves (not independently illustrated) of MPD choke manifold 140. The one or more choke valves of MPD choke manifold 140 controllably divert fluid returns through flow meter 180 to one or more fluids processing systems including, for example, mud-gas-separator 145 and/or shale shakers 150 for processing prior to returning the processed fluid returns (not shown) to mud tanks 175 for reuse. Numerous pressure sensors (not shown) are disposed throughout the fluid path to closely monitor pressure throughout the greater well system.

As part of primary well control, the pressure-tight seal on annulus 130 provided by annular sealing system 105 allows for the precise control of wellbore pressure by manipulation of the choke aperture of one or more choke valves (not independently illustrated) of MPD choke manifold 140 and the corresponding application of surface backpressure. The choke aperture, sometimes referred to as the choke position, of one or more choke valves (not independently illustrated) of MPD choke manifold 140 corresponds to an amount, typically represented as a percentage, that choke valves (not independently illustrated) of MPD choke manifold 140 are open and capable of flowing. Control system 195 may command one or more choke valves (not independently illustrated) of MPD choke manifold 140 to a desired choke aperture setting and/or command the flow rate of mud pumps 170, to manage wellbore pressure. If the choke operator wishes to increase wellbore pressure, the choke aperture setting of one or more choke valves (not independently illustrated) of MPD choke manifold 140 may be reduced to further restrict fluid flow and apply additional surface backpressure. Similarly, if the choke operator wishes to decrease wellbore pressure, the choke aperture setting of one or more choke valves (not independently illustrated) of MPD choke manifold 140 may be increased to increase fluid flow and reduce the amount of applied surface backpressure. All pressure-keeping devices in this fluid path, among many others, are critically important to ensuring primary well control and the safety of operations.

As part of secondary well control, a pressure-tight annular seal is formed by closing BOP 125 when primary well control fails, such as, for example, when there is an unintentional influx of formation fluids that potentially contain explosive gases that must be circulated out of the well system. During such a contingency, fluid returns are taken from below the annular seal and are diverted through choke line 193 to well control choke manifold 190 that directs the fluids returns to the mud-gas-separator 145 to safely remove and dispose of the entrained gases. Similarly, in a controlled well kill operation, heavy fluids are injected below the annular seal to kill the well and prevent further influxes. The kill line 197 fluidly connects well control choke manifold 190 to BOP 125 to inject heavy kill fluids below the annular seal. Similar to primary well control, the proper execution of secondary well control techniques relies upon the pressure-keeping capability of various valves, chokes, manifolds, and other pressure-keeping devices. All pressure-keeping devices in this fluid path, among many others, are critically important to ensuring secondary well control and the safety of operations.

Additionally, one or more pressure relief valves 185 may be used as independent failsafe of last resort to protect rig equipment from damage in the event of uncontrollably rising pressures within drilling system 100. If a predetermined pressure is detected, pressure relief valve 185 rapidly discharges returning fluids from annulus 130 to the fluids processing system or overboard. While pressure relief valve 185 is protective of rig equipment and is designed to release as much pressure as possible as quickly as possible, it does not maintain wellbore pressure, which jeopardizes the structural integrity of the wellbore. Thus, the invocation of pressure relief valve 185 as a failsafe of last resort, requires drastic actions including, for example, closing BOP 125 to secure the well. In such a contingency, the proper function of this and other essential pressure-keeping devices is critical to the safety of operations.

Figure 2:
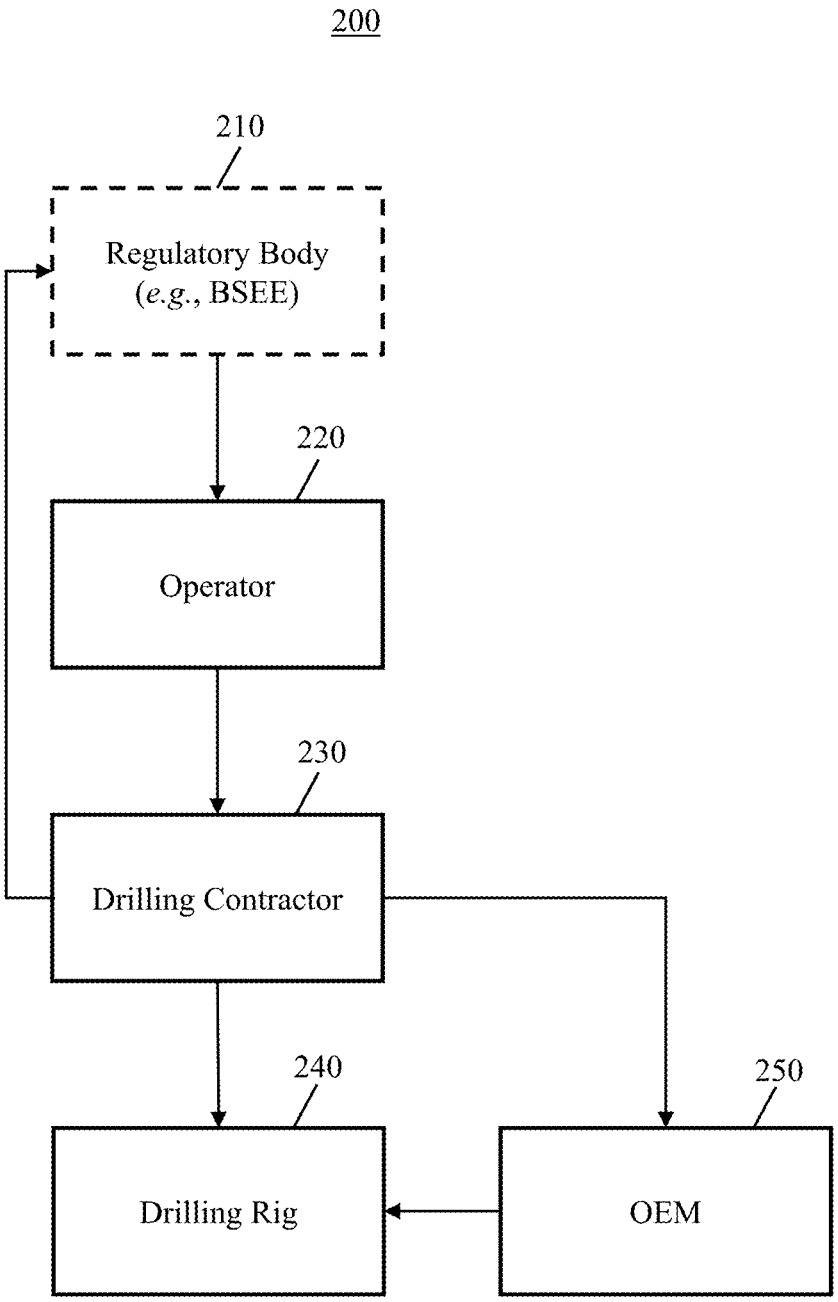
FIG. 2 PRIOR ART
FIG. 2 shows the roles and responsibilities involved in drilling operations.

FIG. 2 shows the roles and responsibilities 200 involved in drilling operations. Several key stakeholders play essential roles in ensuring the efficiency and safety of operations. Regulatory body 210, such as the Bureau of Safety and Environmental Enforcement ("BSEE") in the United States, plays a pivotal role in authorizing and regulating drilling operations to ensure compliance with safety and environmental regulations. Regulatory body 210 is responsible for authorizing and regulating operator 220, typically an oil and gas company that owns exploration and production rights, to drill a given well.

Operator 220 is responsible for planning and overseeing all aspects of the drilling project, including development of the drilling plan, ensuring compliance with regulatory requirements, and managing the budget, schedule, and logistics. Operator 220 has ultimate responsibility to ensure that everything is done properly and coordinates with the other stakeholders to ensure that the project objectives are met. Operator 220 contracts with a drilling contractor 230 to provide drilling rig 240 and conduct drilling operations on their behalf.

Drilling contractor 230 provides drilling rig 240, the crew, and is responsible for the execution of drilling operations. Their responsibilities include maintaining drilling rig 240, ensuring the safety and training of rig personnel, and adhering to the drilling plan provided by operator 220. In addition, drilling contractor 230 is responsible for complying with safety and environmental regulations, conducting regular inspections and maintenance to prevent equipment failures and accidents, executing the pressure test procedures provided by operator 220, and reporting the pressure test results back to operator 220, who later reports the same to regulatory body 210.

Original Equipment Manufacturers ("OEMs") 250 design and manufacture equipment used in offshore drilling operations. Their responsibilities include designing and manufacturing the equipment used by drilling contractor 230 on drilling rig 240, ensuring the reliability and safety of the equipment, and providing technical support, maintenance, and repair services. OEMs 250 must also stay up to date with regulatory requirements.

Regulatory body 210 is responsible for developing and enforcing regulations, conducting inspections and audits, and investigating accidents. They work closely with operator 220, drilling contractor 230, and other stakeholders to promote safety and environmental stewardship in the offshore drilling industry. According to BSEE's Inspection Policy Branch, the agency is required to perform annual in-person inspections of all drilling rigs operating on the Outer Continental Shelf of the United States. BSEE 210 also carries out unscheduled and unannounced in-person inspections of drilling rigs to ensure safety and regulatory compliance, although these inspections are conducted infrequently. Notwithstanding, in the United States, drilling contractor 230 is required to perform periodic pressure testing every fourteen (14) to twenty-one (21) days on essential pressure-keeping devices. As such, the majority of the periodic pressure testing of essential pressure-keeping devices are unsupervised and are only subject to after-the-fact auditing by regulatory body 210 of test results that are self-reported by drilling contractor 230 and operator 220.

Figure 3A:
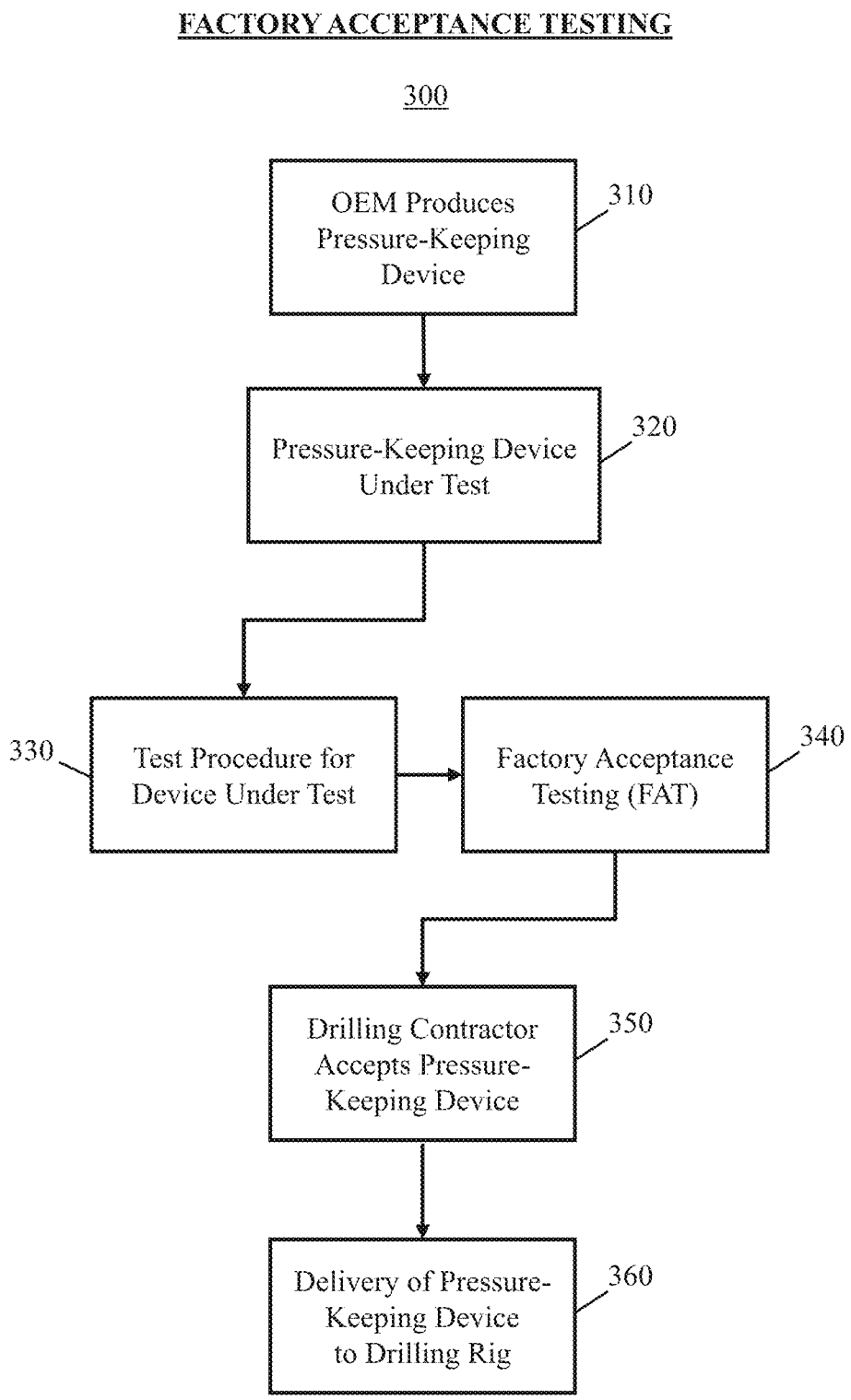
FIG. 3A PRIOR ART
FIG. 3A shows an exemplary Factory Acceptance Testing procedure for a pressure-keeping device under test performed onsite at the Original Equipment Manufacturer's facility prior to delivery to the drilling rig.

FIG. 3A shows an exemplary Factory Acceptance Testing ("FAT") procedure 300 for a pressure-keeping device under test 320 performed onsite at the OEM's factory (not shown) prior to delivery to the drilling rig. OEMs design and manufacture 310 various essential pressure-keeping devices including, but not limited to, BOPs, annular sealing systems, annular closing systems, flow diverters, high-pressure control systems, manifolds, chokes, valves, hoses, and other pressure-keeping devices. During production, OEMs rely on strict quality controls to ensure that these pressure-keeping devices meet specifications and industry standards. As such, the pressure-keeping device under test 320 is subjected to test procedures 330 as part of rigorous FAT 340 to verify its performance and reliability. While test procedures 330 may vary on a device-by-device basis, they generally seek to replicate the operational conditions of the pressure-keeping device under test 320, including the high-pressure and high-temperature environment of use, to identify potential defects before delivery and commissioning.

After completion of FAT 340, the test results are reviewed by the drilling contractor to verify compliance with required specifications, and if the test results are accepted 350, the pressure-keeping device under test 320 is delivered 360 to the drilling rig for installation, site acceptance testing, and commissioning. While the intent of the FAT procedure 300 is to ensure the quality and reliability of the pressure-keeping device under test 320, thereby enhancing the safety of operations, the drilling contractor determines whether to accept the pressure-keeping device under test 320 with minimal oversight, if any, from the operator.

Continuing, FIG. 3B shows an exemplary Site Acceptance Testing ("SAT") procedure 400 for the pressure-keeping device under test 320, performed on the drilling rig. After delivery and installation on the drilling rig 410, the pressure-keeping device under test 320 is subjected to test procedures 430 as part of rigorous SAT 440. This phase of testing 430 verifies that, as received and installed, the pressure-keeping device under test 320 functions correctly within the operational environment of the drilling rig. While test procedures 430 may vary on a device-by-device basis, they generally seek to replicate the operational conditions of the pressure-keeping device under test 320, including the high-pressure and high-temperature environment of use, to confirm that it can maintain pressure and function according to specifications.

During SAT 440, the drilling contractor typically executes a series of tests 430 to assess the performance and reliability of the pressure-keeping device under test 320. These tests 430 may include one or more pressure tests, functional tests, and integration tests to ensure that the pressure-keeping device under test 320 operates seamlessly with other equipment on the drilling rig, as designed and planned. The data collected during these tests 430 are analyzed by the drilling contractor to identify any potential issues. If the pressure-keeping device under test 320 meets all specified criteria and performs satisfactorily, the drilling contractor determines whether to accept 450 it as delivered and installed. Once accepted 450, the pressure-keeping device under test 320 may be commissioned 460 for operative use. Similar to FAT (e.g., 340 of FIG. 3A), the drilling contractor determines whether the pressure-keeping device under test 320 is accepted for use on the drilling rig, with minimal oversight, if any, from the operator.

Figure 3C:
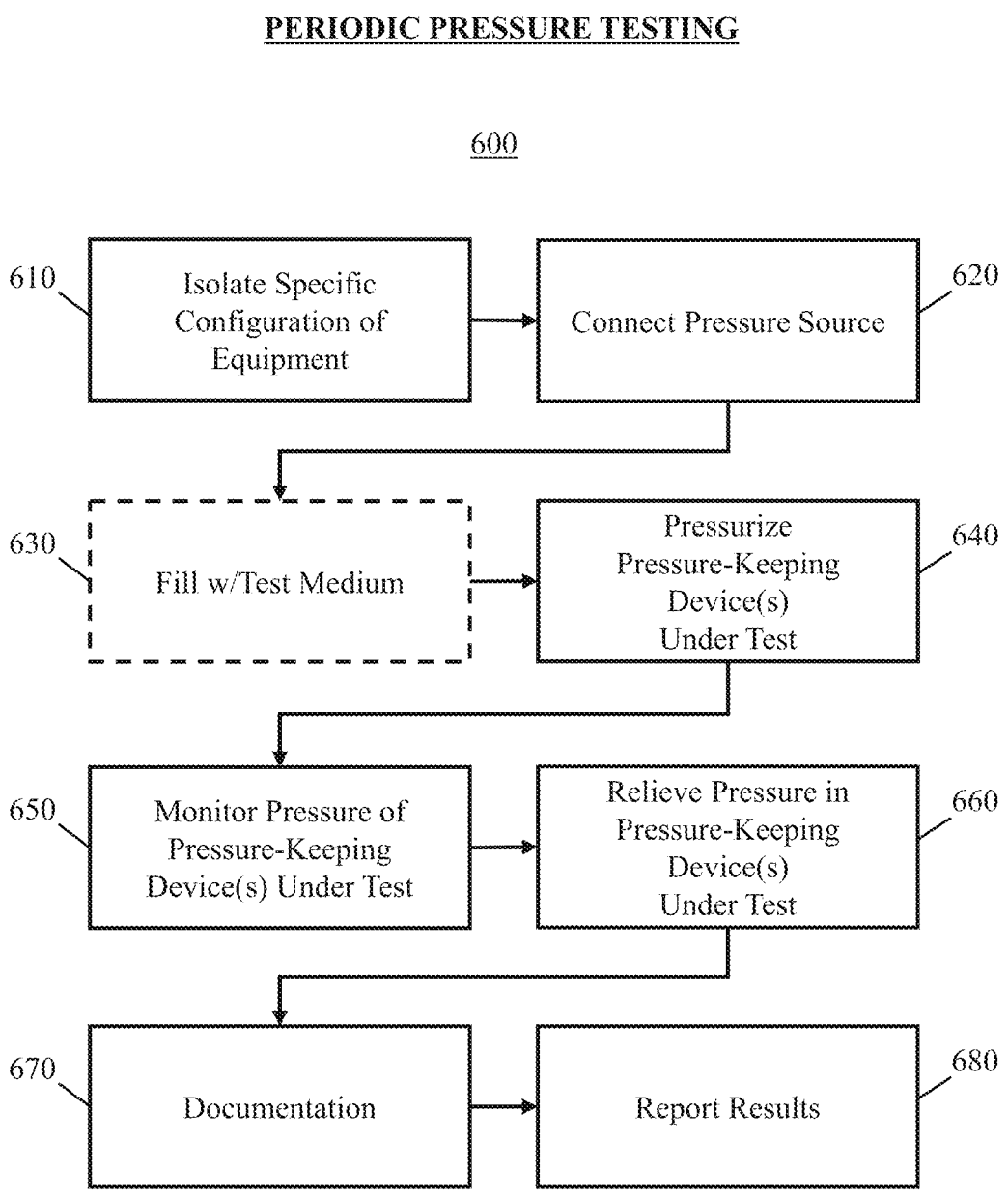
FIG. 3C PRIOR ART
FIG. 3C shows an exemplary periodic testing procedure for one or more pressure-keeping devices under test performed onsite at the drilling rig.

Continuing, FIG. 3C shows an exemplary periodic pressure testing 600 procedure for one or more pressure-keeping devices under test performed onsite at the drilling rig. Periodic testing of essential pressure-keeping devices is a crucial requirement imposed by regulatory authorities to ensure the integrity and safety of drilling operations. The process begins with isolation 610 of a specific configuration of equipment, ensuring that the one or more pressure-keeping devices under test are isolated from the rest of the system to avoid interference and ensure accurate test results. This may involve opening or closing certain valves, disconnecting sections of piping, or using isolation devices.

Once a specific configuration of equipment is isolated, a pressure source 620 is typically connected to the specific configuration of equipment that serves as the connection point for the test equipment and the one or more pressure-keeping devices under test. After connecting the pressure source, the system is filled with a test medium 630, however, in many instances the system is already filled with a suitable test medium, which is usually a fluid that simulates the operational pressures and conditions the one or more pressure-keeping devices under test will encounter during actual operations.

The one or more pressure-keeping devices under test are then pressurized 640 under controlled conditions. During the ramp-up phase the pressure is gradually increased to the desired test level and then the pump is turned off allowing the pressure to stabilize and start the decay period. Once the pressure goes from increasing to decreasing, the system enters the testing phase where the pressure is monitored for a predetermined period of time to ensure that the device can maintain pressure within the acceptance approval criteria. The pressure is closely monitored 650 during a specific duration of time to determine whether the loss of pressure is acceptable, with the goal of identifying any issues that need to be addressed. Typically, a pressure test includes specific criteria, such as the test pressure range, a duration of time to maintain that test pressure (vis-à-vis the test period), and permissible pressure loss over the test period that constitutes a passing result. If the pressure loss over the test period exceeds the permissible amount, it constitutes a failing result.

Upon completing the pressure test, the system is relieved 660 of pressure and the devices are returned to their nominal pre-testing state. In some cases, the testing moves to an even higher pressure, where the one or more pressure-keeping devices under test may be subjected to higher pressure for further testing, repeating the same procedure, but typically with different acceptance criteria from the prior lower pressure test. The responsible party conducting the test documents 670 the test results, detailing the specific configuration of equipment involved in the pressure test, the procedures followed, the conditions observed, and any issues encountered. Finally, the test results are reported 680 to the relevant regulatory authorities to ensure compliance with safety and operational standards.

Despite the safety standards adopted by the industry and the oversight of independent regulatory authorities, there is no effective enforcement of compliance with safety protocols on drilling rigs using conventional state-of-the-art pressure testing systems and methods. While it is well known in the field, though rarely acknowledged publicly, the safety standards adopted by the industry provide little more than a false sense of security, while exposing the rig personnel, the drilling rig, and the environment to unacceptable danger and risks.

At the heart of the issue is the fact that pressure tests are performed using systems and methods that allow for the manipulation and corruption of data such that the data that is reported may not reflect what actually transpired on the drilling rig during testing. Test reports may be manipulated changing the specific configuration of equipment involved in the pressure test, the alignment of one or more valves, and other data such that there is no way to truly know what transpired or ensure compliance with the required procedure for a specific pressure test. While the regulatory authorities are charged with enforcing compliance, as previously noted, they very rarely monitor pressure tests in person on the drilling rig, relying instead on audits of tests reports provided after the fact, with no way to verify whether the test reports are accurate or even whether any of the reported tests were even performed.

As such, under state-of-the-art periodic pressure testing methodology, there is no way to ensure that what is being reported as having been tested is what was actually tested, and the results are simply not reliable. For this reason and others, failures are rarely reported, and the operator and the regulatory authority have little to no knowledge or record of what transpired and are deprived of the ability to provide meaningful oversight. Worse still, a failed test result is sometimes obscured by "double-valving". It has been reported that, in many instances, when a valve is found to be leaking or otherwise failing during a pressure test, a valve downstream is closed, for the purpose of obtaining a passing test result that is typically reported with no reference to the leaking valve or the double-valving employed to obtain the so-called "passing" test result. With the current state-of-the-art, there is simply no way to identify when double-valving has been used.

Figure 4A:
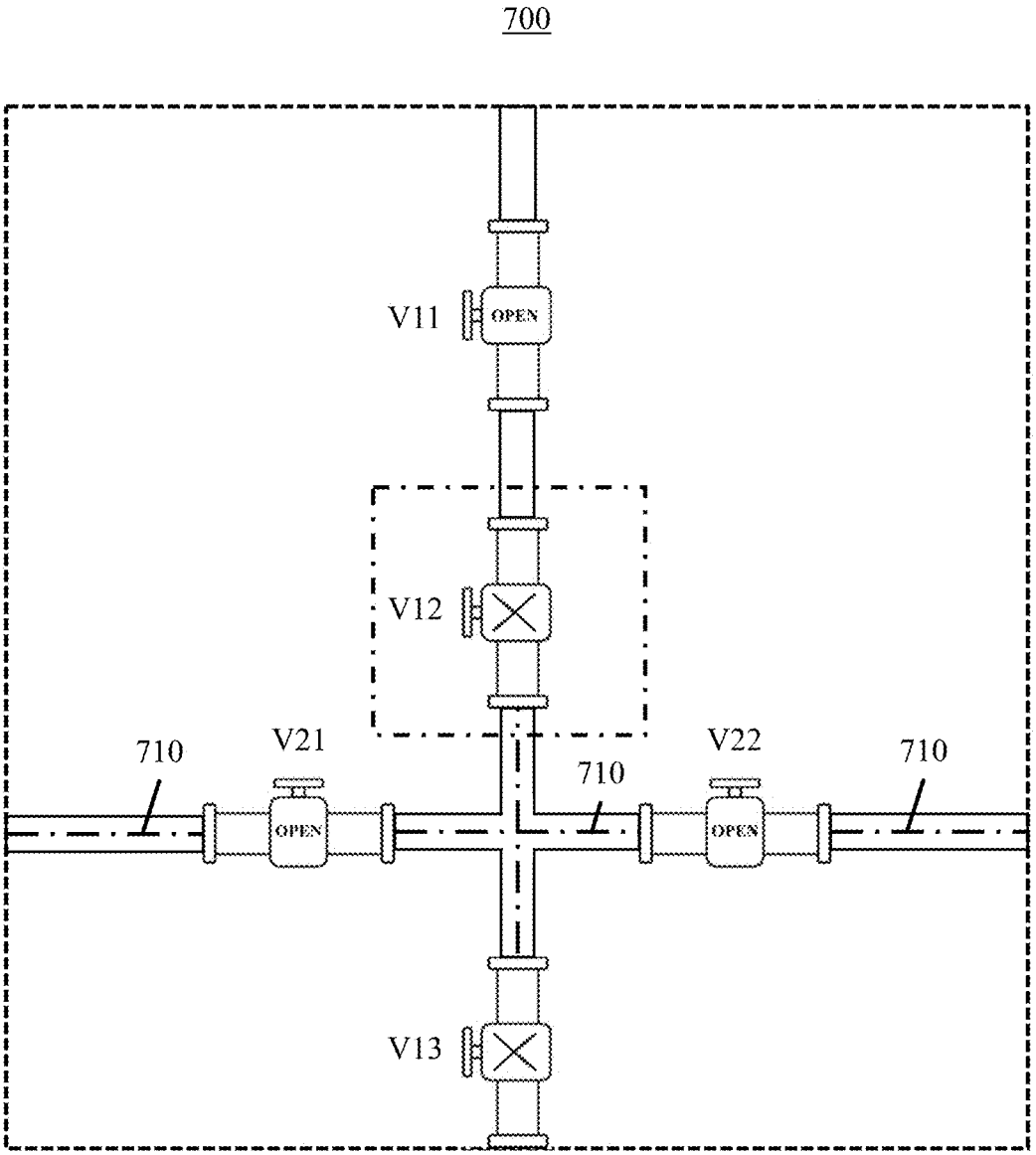
FIG. 4A shows a specific configuration of equipment including one or more pressure-keeping devices under test with a failing valve in the pressure flow path.

FIG. 4A shows a specific configuration 700 of equipment including one or more pressure-keeping devices under test with a failing valve V12 in the pressure flow path. For purposes of illustration, the pressure test includes a specific configuration of equipment that requires the closure of valves V12 and V13 and the opening of valves V21 and V22 such that fluid pressure is conveyed from distal end to distal end of open valves V21 and V22. In this configuration, closed valves V12 and V13 must be able to maintain pressure. However, once pressurized, valve V12 cannot maintain pressure and is leaking. According to standard industry practices, valve V12 should be inspected and either repaired or replaced and the pressure test should be repeated to ensure it is capable of maintaining pressure. The failure, the remedial actions taken, and the repeated pressure test and its result should be fully documented and reported. However, observers on rig have confidentially reported that a failed test result such as this may not be reported and are circumvented by impermissible double-valving. This is made possible by the manual creation of test reports that allow this type of conduct to continue unchecked and the problematic leaking valve remains on the critical path of, for example, critical well control equipment.

Continuing, FIG. 4B shows an undocumented and unreported specific configuration 720 of equipment including one or more pressure-keeping devices under test after double-valving to hide the failure of valve V12 in the pressure flow path. Due to the failure of valve V12, the rig personnel may impermissibly double-valve by closing valve V11 such that the failure of valve V12 is hidden or at least obscured. The rig personnel may then pressurize the test configuration and obtain a "passing" test result. Observers on rig have confided that in such a scenario, they would not report the failure of the initial pressure test, the failure of valve V12, or even the fact that the specific configuration of equipment was reconfigured to close valve V11, instead reporting the "passing" test result as if it represented a passing result with respect to valve V12 as shown in original specific configuration of equipment (700 of FIG. 4A).

Using current state-of-the-art systems and methods for pressure testing, the drilling rig relies on verbal confirmation of valve alignments. On some rigs, after the manually actuated valves are aligned for the next test, additional time is required for the alignment to be manually verified and verbally confirmed before the test starts. Even though time is spent on attempting to confirm the alignment of the valves, the process is still verbal and regardless of how many verbal confirmations are received, in the end, there is no way to ensure that the valves are properly aligned for that specific pressure test. Compliance simply cannot be ensured.

This circumvents the oversight of the regulatory authorities and prevents the operator from having any meaningful insight into the actual condition and performance of pressure-keeping devices on the drilling rig. In the event of a catastrophic event, the concealment of failed test results further complicates efforts to understand what really happened. Consequently, compliance testing has strayed from its original intent of ensuring safety and has devolved into a mere box-ticking exercise aimed at limiting financial losses and mitigating legal liabilities. This has led to a false sense of security for operators and regulatory authorities who are largely kept in the dark despite the fact that periodic pressure testing produces copious amounts of documentation of alleged compliance, that in truth are completely divorced from the reality of the situation. The current situation is not tenable and poses an existential threat to the safety of the rig personnel, the drilling rig, the greater well system, as well as exposing the environment to unnecessary contamination.

For purposes of illustration, a pressure test procedure may include one or more pressure tests that involve one or more pressure-keeping devices on the drilling rig. Each of the one or more pressure tests typically includes a specific configuration of equipment including one or more valves, manifolds, hoses, and other pressure-keeping devices on the drilling rig that must be isolated and properly aligned in order to execute the pressure test. One of ordinary skill in the art will recognize that isolation refers to the use of valves or disconnection to isolate certain flow paths, pressure-keeping devices, and equipment for the purpose of executing a given pressure test. Additionally, one of ordinary skill in the art will recognize that alignment refers to the positioning of valves in either an open state that permits fluid communication or a closed state that prevents fluid communication for the purpose of executing a given pressure test. The network of valves, manifolds, hoses, and other pressure-keeping devices must be properly isolated and properly aligned for a given pressure test and its result to have any meaning. Then the system is pressurized to the specified pressure and the pressure is monitored for a predetermined duration of time. If the pressure does not decay more than a permissible amount during the predetermined duration of time, the test is considered a passing test result. If the pressure decays more than the permissible amount during the predetermined duration of time, the test is considered a failed test result.

On rigs that do not exclusively use electronically and remotely controlled valves, the current state of the art relies on the manual configuration of the one or more valves, manifolds, hoses, and other pressure-keeping devices involved in a given pressure test. Rig personnel literally walk the drilling rig, manually identifying valves and verbally verifying their alignment for the purpose of executing the pressure test. However, the equipment involved in a given pressure test may be located anywhere on the drilling rig, which is a large and expansive structure. From the vantage point of the control room where the pressure test is executed, there is no way to put eyes on all of the equipment involved in the execution of a given pressure test and no way to verify that the proper isolation and alignment were achieved prior to execution of the pressure test. In essence, they are operating in a blind manner.

On rigs that use electronically and remotely controlled valves, the current state of the art relies on the electronically commanded configuration of the one or more valves, manifolds, hoses, and other pressure-keeping devices involved in a given pressure test by rig personnel. The rig personnel commands the alignment of one or more valves involved in a pressure test to a desired alignment via a console of a control system. However, because the rig personnel are fallible humans, they may not properly identify all of the equipment involved in the specific configuration of equipment, they may not properly command the alignment of the valves necessary to isolate the one or more pressure-keeping devices under test, and they may not properly document what they have done.

As such, it is exceptionally difficult to determine, after the fact, what was actually tested, if anything, and the test results are typically speculative at best. Worse still, even when this procedure is flawlessly performed, given the size of the drilling rig, there is no guarantee that valves that were properly aligned remain properly aligned by the time the pressure test is actually executed from the control room. Thus, there is no way to ensure and verify that the proper specific configuration of equipment was tested, that the pressure-keeping devices involved in the pressure test were properly isolated, that the valves involved in the pressure test were properly aligned, and that the pressure sensors were in calibration. While this clearly calls the validity of any pressure test procedure or pressure test into question, it also potentially places the rig personnel, the drilling rig, and the greater well system in danger when improperly tested pressure-keeping devices are put into high-pressure conditions of operative use.

Consequently, the stakeholders cannot even guarantee that a test was actually performed at all, whether the specific configuration of equipment involved in the pressure test was properly isolated at the time the test was executed, whether the valves were properly aligned at the time the test was executed, whether the pressure sensors were in calibration, or whether the results of the pressure test are valid. All of which makes any result, pass or fail, virtually meaningless. Put frankly, the test results are essentially worthless because there is no way to validate what has transpired during the pressure test, with no meaningful opportunity for verification or oversight by interested parties. The harsh reality is that no one really knows what is being tested, but it is common knowledge that nothing is being tested effectively, and the results are essentially meaningless.

To address this, it is essential to realign compliance testing with its original intent. This involves adopting a radically different approach that prioritizes the enforcement of compliance. By focusing on genuine risk mitigation and proactive safety management, the industry can better ensure that compliance testing serves its true purpose: ensuring the safety of the rig personnel, the drilling rig, and the greater well system, as well as protecting the environment from contamination and fouling.

Accordingly, in one or more embodiments of the present invention, a method of compliance enforcement of safety protocols on a drilling rig provides an immutable record of actual compliance activities that take place on a drilling rig, preventing the gaming of the system and the concealment of failures. Operators, drilling contractors, regulatory authorities, and other interested parties will have access to actual and reliable compliance data that enables them to provide, for the very first time, actual oversight. To that end, the method receives and validates a pressure test procedure, receives and validates the alignment of one or more valves involved in the pressure test, and optionally receives and validates the calibration of one or more pressure sensors involved in the pressure test. This significantly enhances safety by preventing the execution of a pressure test that poses unwarranted danger or risk.

In one or more embodiments of the present invention, a method of compliance enforcement of safety protocols on drilling rigs enables the immutable validation and reporting of a pressure test procedure, the isolation of a specific configuration of equipment for a given pressure test, an alignment of one or more valves involved in the pressure test, and a calibration of one or more pressure sensors involved in the pressure test, eliminating the potential for human error, intentional concealment, or misreporting of actual events. Prior to execution of a pressure test, the pressure test procedure is validated and accepted before the test is started, thereby enhancing operational safety. Notwithstanding, everything that transpires is immutably documented and reported.

In one or more embodiments of the present invention, a method of compliance enforcement of safety protocols on drilling rigs enables the immutable validation and reporting of the isolation of the specific configuration of equipment and the alignment of one or more valves required to isolate and pressurize the one or more pressure-keeping devices under test, prior to pressurization, thereby enhancing operational safety. Notwithstanding, everything that transpires is immutably documented and reported.

In one or more embodiments of the present invention, a method of compliance enforcement of safety protocols on drilling rigs immutably reports data including all inputs, validation, and reporting on pressure test procedures, specific configurations of equipment, pressure tests, calibration data, pressure measurements, and test results, to the interested parties, without permitting modification of the data, concealment of failed test results, or gaming of the system, thereby eliminating self-reporting and self-certifying of test results. For the first time, stakeholders have access to accurate, reliable, and actionable information regarding the actual condition and performance of pressure-keeping devices on the drilling rig.

In one or more embodiments of the present invention, a method of compliance enforcement of safety protocols on a drilling rig enables remote management, allowing stakeholders to monitor in real-time the preparation, pre-test validations, and execution of pressure tests taking place on remote drilling rigs located anywhere in the world and provide valuable expertise, should a contingency arise. This also enables the concentration of expertise in one location to serve a fleet of remote drilling rigs located anywhere around the globe.

In one or more embodiments of the present invention, a method of compliance enforcement of safety protocols on drilling rigs substantially enhances the safety of pressure tests and by extension the safety of rig personnel, the drilling rig, and the greater well system, as well as protects the environment.

Figure 5:
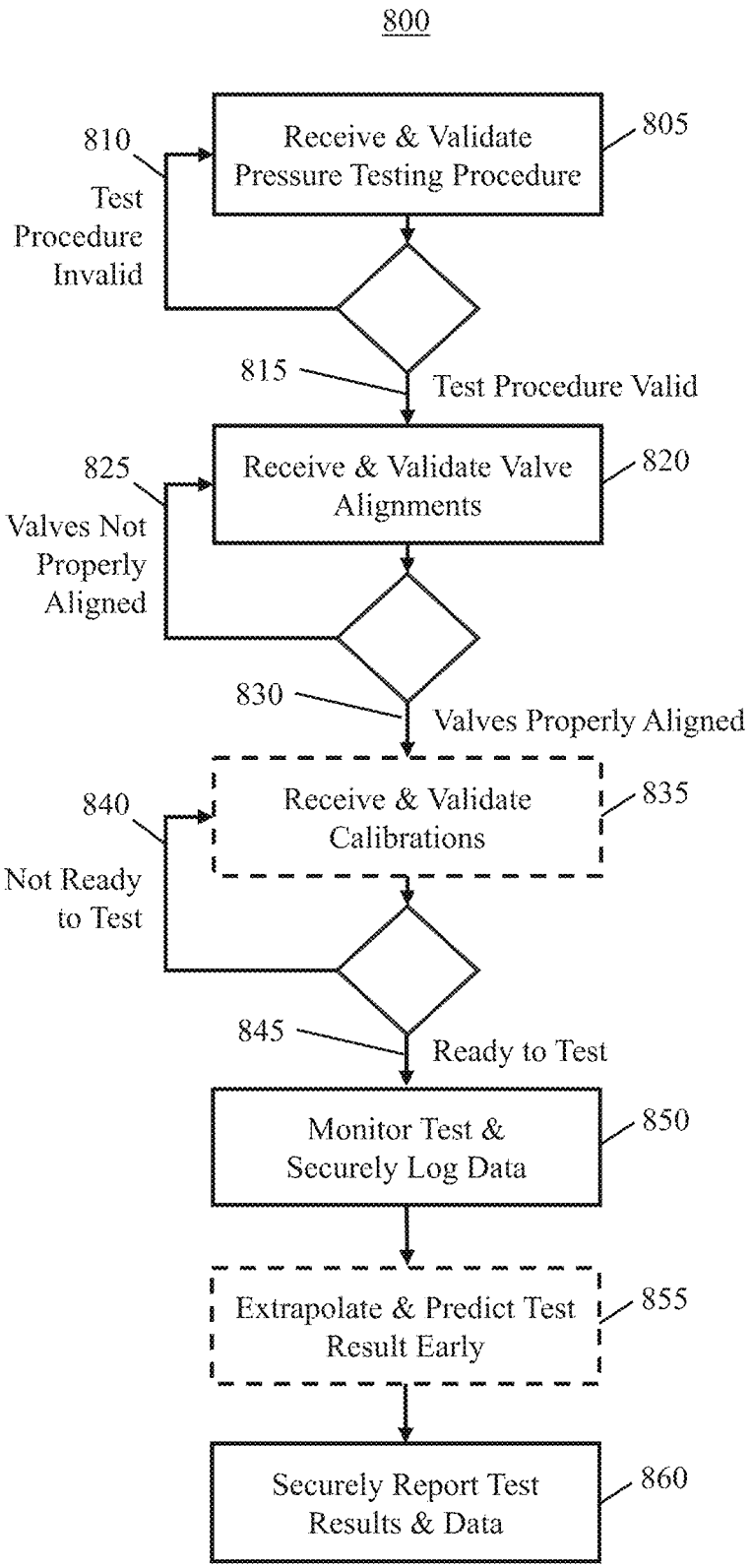
FIG. 5 shows a method of compliance enforcement of safety protocols on a drilling rig in accordance with one or more embodiments of the present invention.

FIG. 5 shows a method 800 of compliance enforcement of safety protocols on a drilling rig in accordance with one or more embodiments of the present invention.

In step 805, a computing system disposed on the drilling rig, may receive a pressure test procedure comprising a pressure test for one or more pressure-keeping devices under test and a specific configuration of equipment involved in the pressure test. The specific configuration of equipment involved in the pressure test may include one or more valves, manifolds, hoses, and other pressure-keeping equipment as well as desired alignment information for one or more valves that isolate and enable the pressurization of the one or more pressure-keeping devices under test in accordance with the pressure test to be executed. The computing system may receive the pressure test procedure from a technician on the drilling rig, which may be based on a pressure test procedure promulgated by the operator or the regulatory authority. In certain embodiments a graphical representation of the equipment on the drilling rig may be displayed by the computing system to enable the technician to graphically identify the one or more pressure keeping devices under test as well as the specific configuration of equipment, as implemented on the drilling rig, for the given pressure test. In this way, a technician on the drilling rig may visually configure the pressure test procedure and the specific configuration of equipment as implemented on the drilling rig in accordance with the pressure test to be executed, while the computing system creates an immutable log of everything that transpires and cannot be altered. In this context, immutable means once logged, there is no opportunity for anyone involved to modify the data contained therein.

Each pressure test may include a ramp up period, an acceptable test pressure range, a settle period, a duration of time to maintain the test pressure, and an acceptable amount of decay from the test pressure over the duration of time constituting a passing test result. When a pressure test is executed, the pressure in the specific configuration of equipment is ramped up to the test pressure, allowed to settle, and then the pressure is monitored for the specified duration of time. If the pressure decays less than the acceptable amount of decay during the duration of time, it is considered a passing test result. Conversely, if the pressure decays more than the acceptable amount of decay during the duration of time, it is considered a failing test result. The ramp up period, test pressure, settle period, duration of time to maintain the test pressure, and acceptable amount of decay may vary based on the pressure test and the specific configuration of equipment for a particular pressure test.

The computing system may validate the pressure test procedure by determining whether the specific configuration of equipment, as implemented on the drilling rig, is capable of isolating and pressurizing the one or more pressure-keeping devices under test in accordance with the pressure test. The computing system may use the pressure test procedure, the specific configuration of equipment involved in the pressure test as implemented on the drilling rig, as well as information relating to the alignment of one or more valves required to isolate and pressurize the specific configuration of equipment to identify pressure flow paths to determine whether the requisite isolation and pressurization can be achieved. For purposes of illustration, a graphical representation of the specific configuration of equipment permits the computing system to identify pressure flow paths in view of valve alignments by tracing pressure flow paths from input to each and every pressure-keeping device under test as well as closed valves or isolation devices to ensure that the requisite isolation and pressurization can be achieved.

In step 810, the pressure test procedure may be determined to be invalid if the specific configuration of equipment as implemented on the drilling rig is not capable of being isolated and pressurized as required by the pressure test for the one or more pressure-keeping devices under test. If the pressure test procedure is determined to be invalid, the computing system may provide a graphical indication that the pressure test procedure is flawed and that the pressure test should not be executed. In certain embodiments, the graphical representation of equipment on the drilling rig may provide context clues as to which piece or pieces of equipment are at issue, permitting the debug of the pressure test procedure or specific configuration of equipment as input to the computing system. For purposes of illustration, if the tracing of pressure flow paths reaches an erroneously open valve that prevents isolation or pressurization, that valve may be graphically highlighted so that the personnel may investigate the configuration issue.

In step 815, the pressure test procedure may be determined to be valid if the specific configuration of equipment, as implemented on the drilling rig, is capable of being isolated and pressurized as required by the pressure test for the one or more pressure-keeping devices under test. For purposes of illustration, the computing system may trace the pressure flow path from input through to every terminal node (e.g., closed valve) from a pressure keeping perspective that is on the pressure flow path to ensure that the requisite isolation and pressurization of the specific configuration of equipment is achievable. Upon confirmation, the computing system may provide a graphical indication that the pressure test procedure is valid.

In step 820, the computing system may receive a current alignment for each of one or more valves required to isolate and pressurize the one or more pressure-keeping devices under test in accordance with the pressure test, where each of the one or more valves communicates its current alignment to the computing system. A drilling rig includes a significant amount of interconnected equipment, including isolation valves, redirection valves, choke valves, relief valves, and check valves among others, which provide flexibility in the fluid communication between equipment. A pressure test for one or more pressure-keeping devices under test requires the isolation of a specific configuration of equipment that enables the disconnection of the one or more pressure-keeping devices under test from the rest of the equipment, permitting the optional connection of a pressure source that fluidly communicates a test medium, and the alignment of the valves that enable the isolation and pressurization of the one or more pressure-keeping devices under test in accordance with the pressure test.

The computing system may validate the current alignment for each of the one or more valves required to isolate and pressurize the one or more pressure-keeping devices under test in accordance with the pressure test. The validation may include receiving, at the computing system, a current alignment from each of the one or more valves and comparing the current alignment to the specific configuration of equipment involved in the pressure test to determine whether it properly isolates and enables pressurization of the one or more pressure-keeping devices under test through examination of the flow paths and alignments from input through to every terminal node (e.g., closed valve), from a pressure keeping perspective, that is on the pressure flow path.

A drilling rig includes a number of valves, manifolds, hoses, and other equipment that have to be aligned based on a desired flow path of the pressure carrying medium to pressurize the one or more pressure-keeping devices under test. Some valves are electronically actuated and are capable of communicating their sensed current alignment to the computing system. Manually actuated valves, such as, for example, handwheel valves, are not electronically actuatable, however, they may be equipped with position sensors, rotary encoders, or other equipment that is capable of communicating its current alignment to the computing system. As such, manually actuated valves as well as electronically actuated valves or mixtures thereof may be used so long as the manually actuated valves are equipped with position sensors or rotary encoders that communicate their current alignment to the computing system. On drilling rigs that include manually actuated valves that are not equipped with position sensors or rotary encoders, position sensors or rotary encoders may be installed to ensure they are capable of accurately communicating their current alignment to the computing system.

In step 825, if any of the one or more valves required to isolate and pressurize the one or more pressure-keeping devices under test are found to be misaligned, based on the sensed current alignment received by the computing system from one or more valves, the computing system may provide a graphical representation of the specific configuration of equipment, identifying the one or more valves that are misaligned and a graphical indication that the pressure test should not be executed. The rig personnel may then command the one or more misaligned electronically actuated valves to the proper alignment, manually align the one or more misaligned manually actuated valves, or investigate and repair in the event of a failure. In step 830, if the one or more valves required to isolate and pressurize the one or more pressure-keeping devices under test are properly aligned, based on the sensed current alignment received by the computing system from each of the one or more valves, the computing system may provide a graphical indication that the one or more valves are properly aligned.

In step 835, the computing system may run through one or more pre-test validation procedures to determine whether the pressure test is ready to execute. These procedures may include a determination whether the specific configuration of equipment is properly isolated, whether the one or more valves are properly aligned to enable pressurization of the one or more pressure-keeping devices under test, and validation of the current calibration for each of the one or more pressure sensors involved in the pressure test. The computing system may receive a current calibration for each of one or more pressure sensors involved in the pressure test. The computing system may validate the current calibration for each of the one or more pressure sensors is within a currently valid calibration interval. In step 840, if a pre-test validation procedure fails, the computing system may provide a graphical representation of the failure, including, for example, an indication that a specific pressure sensor is out of calibration. Conversely, in step 845, if the one or more pre-test validations pass, the drilling rig may be ready to execute the pressure test and the computing system may provide a graphical indication that the pressure test is safe to execute based on the validation of the pressure test procedure, the validation of the specific configuration of equipment involved in the pressure test as implemented on the drilling rig, the validation of the alignment of the one or more valves involved in the pressure test, and the validation of the calibration information for the one or more pressure sensors. In step 850 the computing system may provide a graphical indication that the pressure test is ready to be executed. Rig personnel may then commence the pressure test, increasing the pressure accordingly, while the computing system monitors and logs all relevant data during the test.

In one or more embodiments of the present invention, the method of compliance enforcement of safety protocols on drilling rigs prevents the execution of flawed and dangerous test configurations and immutably validates and reports everything that transpires on the drilling rig during periodic pressure testing. However, to be clear, a technician on the drilling rig is responsible for commanding the position of valves, starting the pumps, and executing the pressure tests themselves. Once started, the one or more pressure-keeping devices under test may be pressurized in accordance with the pressure test procedure. As noted above, this may include a ramp up period to attain the test pressure, a settling period, and then a duration of time during which the test pressure is monitored for decay. The computing system may receive sensed pressure data from the one or more pressure-keeping devices under test as well as other pressure sensors during at least the duration of the pressure test. The computing system may immutably log the sensed pressure data as well as the pressure test procedure, pressure test, and specific configuration of equipment for documentation purposes.

In step 855, the computing system may optionally, while receiving sensed pressure data during the pressure test, extrapolate the sensed pressure data to predict the anticipated pressure throughout at least a remainder of the duration of the test currently underway. One of ordinary skill in the art, having the benefit of this disclosure, will appreciate that extrapolation is typically performed based on one or more well known mathematical techniques including, for example, regression analysis, time series analysis, machine learning models, physical-based models, exponential smoothing, or filtering. The computing system may provide a graphical representation of the sensed pressure, the extrapolated pressure, and an early prediction of the pressure test result prior to the expiration of the duration of time of the pressure test. Confidence intervals may also be calculated and displayed based on the sensed pressure data and the extrapolation of pressure. The confidence intervals provide a range within which the true value of the predicted pressure is likely to fall based on variability of the data and the level of confidence specified. The extrapolation and confidence intervals may be continuously updated as the pressure test continues. In certain applications, a predicted pressure within a prescribed confidence interval may be used by the computing system to suggest an end to a pressure test earlier than the duration of time and come to a pass or fail result substantially earlier. In other applications, where the use of an extrapolated test result may not be permissible for purposes of demonstrating and documenting safety, it may be used by the computing system as an additional layer of safety by suggesting an early end to a pressure test that is predicted to fail. Safety is enhanced by ending a failing test early as failure may indicate a serious problem with one or more pressure-keeping devices under test. The computing system may provide a graphical representation of the sensed pressure data, the extrapolated pressure data, the confidence intervals, and a prediction as to whether the pressure test will pass or fail.

The computing system may, based on the pressure test procedure and pressure test, make a determination whether a result of the pressure test meets passing criteria. As noted above, the passing criteria may include a test pressure that decays less than an acceptable amount of decay during the duration of the pressure test. If the test pressure decays more than the acceptable amount of decay during the duration of the pressure test, it is determined to be a failing test result. In step 860, the computing system may generate an immutable report on the pressure test comprising one or more of the received pressure test procedure, the pressure test, the specific configuration of equipment, the validation of the pressure test procedure, the received alignment of the one or more valves, the validation of the alignment of the one or more valves, the received calibration information for the one or more pressure sensors, the validation of the calibration information for the one or more pressure sensors, and the sensed pressure data from execution of the pressure test. The immutable report on the pressure test may be transmitted to a remote server over a network connection to the Internet. Offshore drilling rigs include, for example, satellite connections to the Internet, such that the computing system could transmit the immutable report to a remote server of the stakeholders or their designees. The immutable report may be encrypted to ensure it may only be viewed by the proper recipients. Advantageously, the immutable report records all available information that is transmitted to a remote server that is located off of the drilling rig without any opportunity for modification or corruption, ensuring that failing test results, debug activities, and meaningful and validated information about the pressure tests actually conducted, such that, for the very first time, the results are meaningful.

In one or more embodiments of the present invention, the immutable report may include sufficient data that permits the computing system or a remote viewer to replay what transpired during a previously executed pressure test, providing insight into everything that happened at any given moment during the pressure test.

One of ordinary skill in the art, having the benefit of this disclosure, will recognize that one or more of the steps outlined above, a subset, or a superset thereof, may be used based on an application or design in accordance with one or more embodiments of the present invention. While those steps indicated as optional in the description above or shown in dashed lines in FIG. 5 are optional, in one or more embodiments of the present invention, a method of compliance enforcement of safety protocols on a drilling rig requires receiving and validating the current alignment of each of the one or more valves and receiving and validating the current calibration of each of the one or more pressure sensors involved in the pressure test.

Figure 6A:
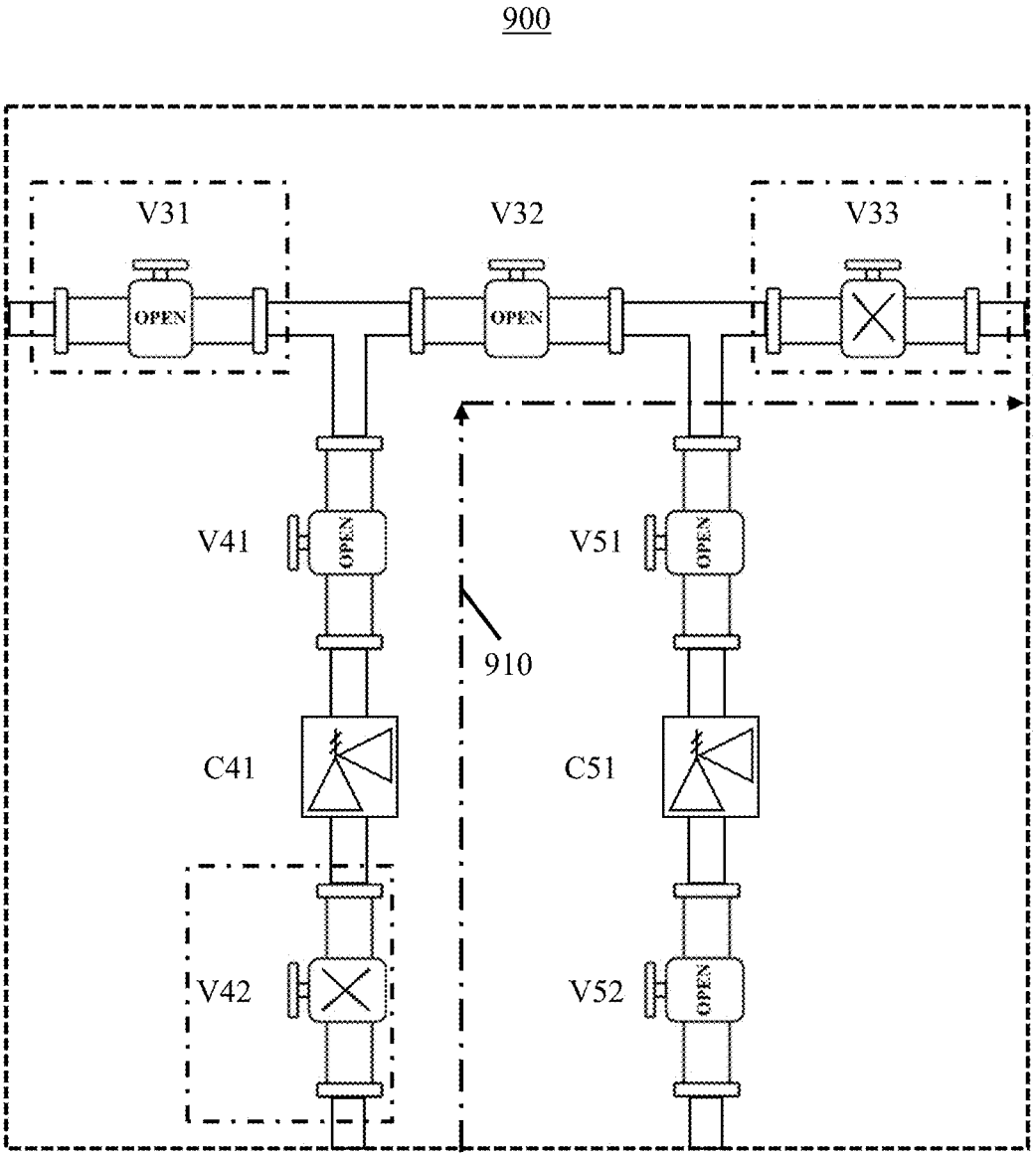
FIG. 6A shows a graphical display of the current alignment of a subset of valves on the drilling rig as part of an exemplary pressure test in accordance with one or more embodiments of the present invention.

FIG. 6A shows a graphical display 900 of a current alignment of a subset of valves (e.g., V31, V32, V33, V41, C41, V42, V51, C51, V52) on the drilling rig as part of an exemplary pressure test in accordance with one or more embodiments of the present invention. This graphical display simplifies the complex array of valves that need to be correctly aligned to isolate and pressurize the pressure-keeping devices under test (not shown). The valves' proper alignment is crucial for ensuring the test's success, as misaligned valves can prevent the desired isolation and pressurization. For purposes of illustration, a desired flow path 910 is shown that is determined by the control system as being necessary to isolate and pressurize the pressure-keeping device under test (not shown). As shown in the figure, valve V42 is misaligned such that fluids cannot flow through desired flow path 910. For example, valves V31, V33, and V42 may be misaligned, leading to interruptions in the flow paths required for accurate testing. The graphical representation of the interconnected flow paths provides a visual indication of these misalignments, indicating where adjustments are necessary to establish the required flow path. This visual tool enables the operator to quickly identify and rectify alignment issues, ensuring the pressure test's reliability and accuracy.

Continuing, FIG. 6B shows a graphical display 920 of the validated alignment of the same subset valves on the drilling rig as part of the exemplary pressure test in accordance with one or more embodiments of the present invention. Recognizing the misalignment of valves V31, V33, and V42, the technician may command these valves to the proper alignment via their own rig control system. This realignment achieves the desired flow path that isolates the specific configuration of equipment and allows for the pressurization of the pressure-keeping device under test in accordance with the pressure test. The computing system is able to receive and validate these alignments as they are taking place to ensure that any pressure test is conducted under safe conditions consistent with the pressure test procedure.

Figure 7:
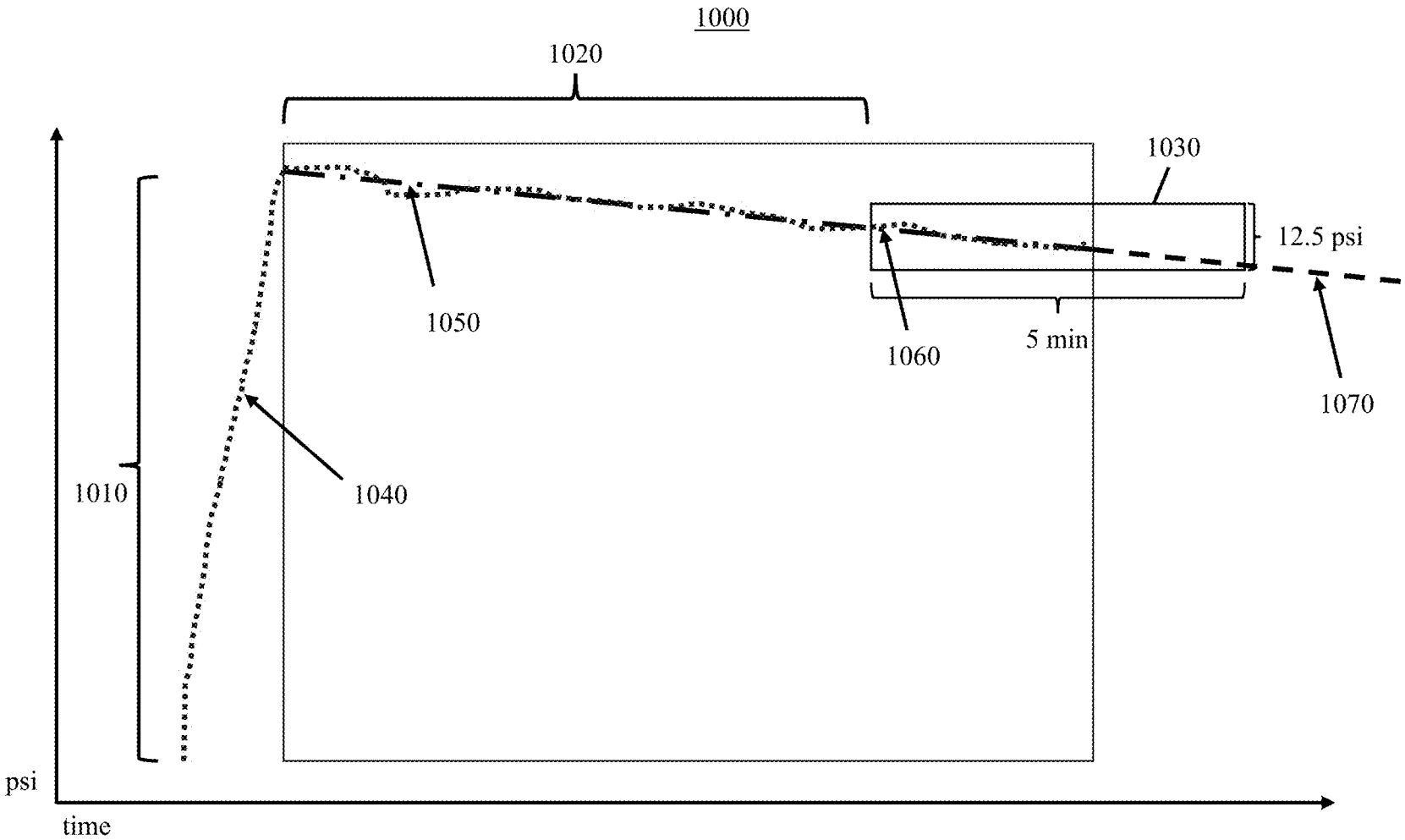
FIG. 7 shows an exemplary extrapolation of pressure testing data of an exemplary pressure test to obtain an early prediction of a test result in accordance with one or more embodiments of the present invention.

FIG. 7 shows an exemplary extrapolation 1000 of pressure testing data of an exemplary pressure test to obtain an early prediction of a test result in accordance with one or more embodiments of the present invention.

In a pressure test for a pressure-keeping device, the initial phase involves a ramp-up period 1010 where the equipment is gradually pressurized to the prescribed test pressure range. This controlled increase in pressure ensures that the equipment can handle the stress and allows for the detection of any immediate issues. Once the test pressure is reached, the system enters a settling period 1020, during which the pressure is held steady. The pressure is maintained for a duration of time 1030 and carefully monitored for decay that may indicate potential leaks or weaknesses in the pressure-keeping devices.

The test is deemed to have failed if the pressure decays more than a predetermined acceptable amount prescribed by the pressure test over the monitored duration of time. Optionally, extrapolation may be used to help pass or fail the test at an earlier time than the specified duration of time. The extrapolation criteria may be defined in the test procedure depending on the pressure-keeping device being tested. In certain scenarios, the test can be ended early based on a predicted test result obtained through extrapolation. While an extrapolated passing test result may not be acceptable to a given regulatory authority, the ability to quickly come to a conclusion that the test is likely to fail can expedite the termination of the test to protect the safety of the rig personnel, the drilling rig, and the greater well system.

To extrapolate the test results and potentially end the test early, a mathematical model can be employed to predict the long-term behavior of the pressure within the system. By analyzing the rate of pressure decay during the initial stages of the monitoring phase, it is possible to estimate the pressure behavior over the entire test duration. If the early data suggests that the pressure decay is within acceptable limits and follows a predictable pattern, the test can be safely ended early with a predicted passing result. This method relies on the accuracy of the mathematical model and the assumption that the pressure decay will continue in the same manner as observed during the initial monitoring period.

The extrapolation process involves fitting the observed pressure decay data to a predefined decay curve, which represents the expected behavior of the pressure-keeping device under test. Various statistical techniques, such as regression analysis, can be used to determine the best fit for the data. Once the decay curve is established, the model can predict the future pressure values and determine if the pressure will remain within acceptable limits for the remainder of the test duration. This predictive approach allows for the early termination of the test while still ensuring the reliability and safety of the equipment. It is essential, however, to validate the model periodically and adjust it based on empirical data to maintain its accuracy and reliability.

In the example depicted in the figure, the sensed pressure is represented by a dotted line, showing the sensed pressure 1040 during ramp up period 1010, the sensed pressure 1050 during the settling period 1020, and the sensed pressure 1060 during the test and monitoring period 1030, and the extrapolation of the sensed pressure 1070. While the use of extrapolation may not be permitted in periodic testing, it does save time and reduce risks by providing meaningful feedback that permits the rig personnel to terminate the pressure test early when something is not right.

In the context of pressure tests for pressure-keeping devices, confidence intervals can be used to quantify the uncertainty associated with the predicted test results when extrapolating the pressure decay. Confidence intervals provide a range of values within which the true pressure behavior is likely to fall, with a certain level of confidence. This statistical method helps ensure that the early termination of the pressure test, based on extrapolated results, is both reliable and accurate.

During the pressure test, the computing system collects pressure data at various time intervals. By analyzing this data, a mathematical model can be developed to describe the pressure decay behavior. The model uses the observed data to estimate parameters such as the rate of pressure decay. Once the model is fitted to the data, it can generate predictions for future pressure values. However, these predictions are subject to uncertainty due to potential variations in the equipment's performance and environmental factors.

To account for this uncertainty, confidence intervals are calculated around the predicted pressure values. For example, a 95% confidence interval means that there is a 95% probability that the true pressure value will fall within the specified range. This interval provides a buffer that accounts for possible deviations from the predicted values, ensuring that the pressure test results are robust.

When determining whether to suggest an early end to the pressure test, the computing system uses the confidence intervals to assess the reliability of the predicted results. If the predicted pressure values, along with their confidence intervals, indicate that the pressure decay is within acceptable limits, the test can be safely terminated early. This approach minimizes the risk of false conclusions by providing a statistically sound basis for decision-making. Conversely, if the confidence intervals indicate a high degree of uncertainty or suggest that the pressure decay may exceed acceptable limits, the test should continue for the full duration to obtain more data and reduce uncertainty.

Figure 8:
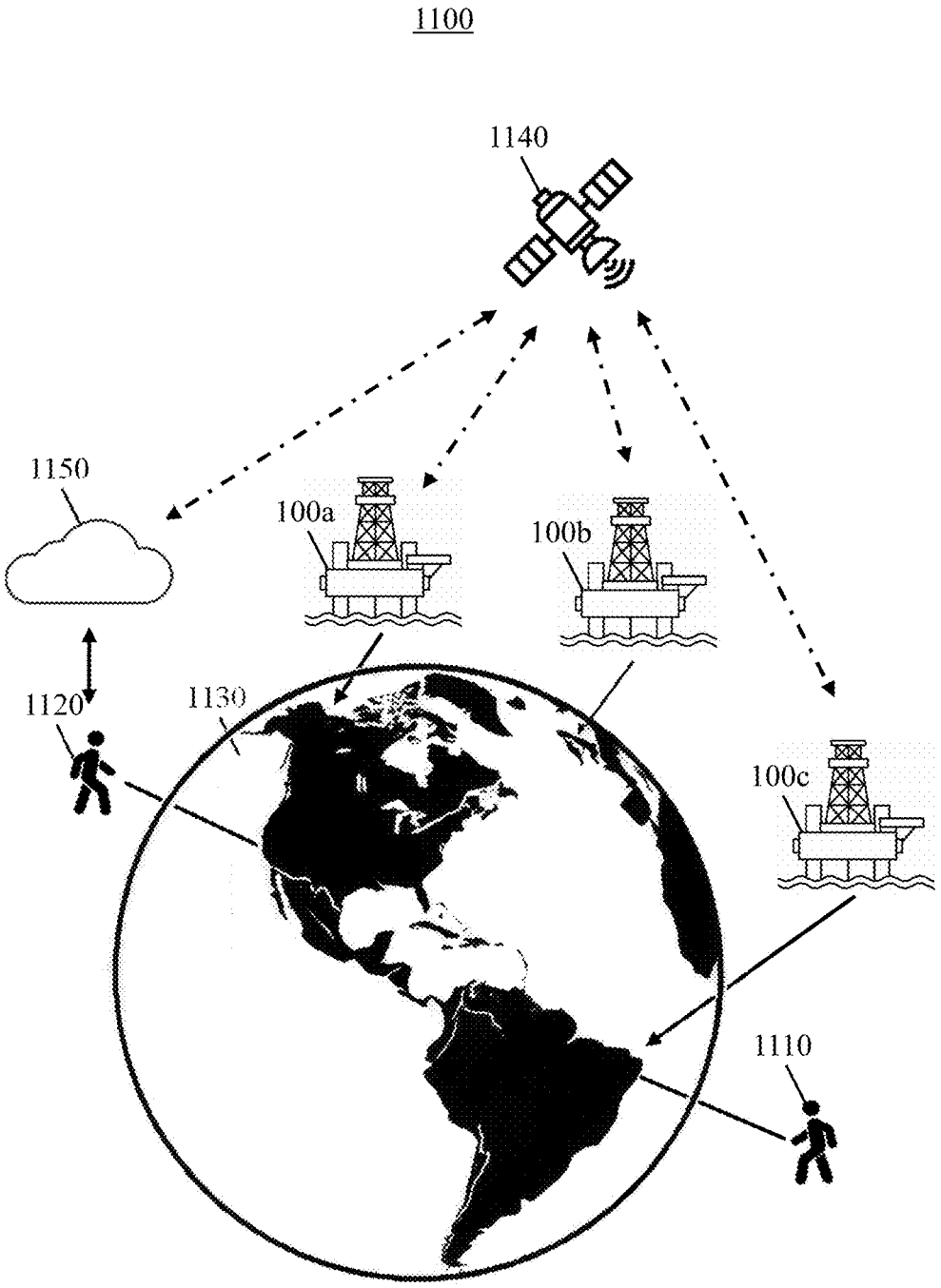
FIG. 8 shows remote management of compliance enforcement of safety protocols on a plurality of remotely located drilling rigs in accordance with one or more embodiments of the present invention.

FIG. 8 shows remote management 1100 of compliance enforcement of safety protocols on a plurality of remotely located drilling rigs in accordance with one or more embodiments of the present invention.

Given the significant risks and challenges associated with compliance testing for pressure-keeping devices on drilling rigs a method of compliance enforcement of safety protocols immutably validates and documents pressure test procedures and pressure tests without permitting modification or corruption of the related data.

For purposes of illustration, an operator 1110 located in Brazil may engage a drilling contractor located in Texas to undertake one or more drilling projects that span the globe 1130, including, for example, a drilling rig 100*a* disposed offshore in the North Slope of Alaska, a drilling rig 100*b* disposed offshore in the North Sea, and a drilling rig 100*c* disposed in offshore Brazil. Each of the drilling rigs may have satellite 1140 communication capabilities establishing a network connection to the Internet. Under the current state of the art, operator 1110 located in Brazil has little to no visibility or oversight of the periodic testing taking place on the offshore drilling rigs 100*a*, 100*b*, 100*c*. Instead, the operator at best has the ability to see logs of tests self-reported, with little to no oversight. While regulatory authorities have the option of inspecting on site, because of the difficulty and expense of getting on an offshore drilling rig in deepwater, they often rely on auditing the self-reported logs of pressure tests. As discussed above, there is no way for the stakeholders to truly verify whether a pressure test was actually performed, much less the validity of its result.

In one or more embodiments of the present invention, remote management enables real-time monitoring, oversight, and even control of pressure tests from a remote location. Operators and regulatory authorities can access the control system and the computing system of the drilling rig via secure connections, obtaining a comprehensive view of the equipment configuration, valve alignment, and test progress. This real-time visibility allows for immediate identification and correction of any misalignments or deviations, ensuring that pressure tests are conducted accurately and safely.

The computing system may be equipped with advanced analytics and machine learning algorithms that continuously analyze pressure test data. These algorithms can detect patterns and predict potential issues, allowing for proactive maintenance and troubleshooting. By utilizing predictive models, the system can estimate the long-term behavior of pressure-keeping devices, enabling the early termination of tests based on reliable extrapolated results. This approach not only optimizes testing procedures but also minimizes downtime and reduces operational costs.

Furthermore, remote management may be used for strict compliance with safety protocols by locking out pressure tests that do not meet all validation and verification requirements. If the equipment configuration or valve alignment is incorrect, the system provides an indication that the test should not proceed and provides detailed feedback to the technicians on the drilling rig. This compliance enforcement eliminates the potential for human error, the concealment of failures, and misreporting, thereby ensuring that test results have actual meaning backed up by validated and immutable data stored and reported to remote server 1150.

Remote management provides real-time transparency, ensuring that the results are meaningful and reliable. This innovative approach realigns compliance testing with its original intent of protecting lives, the environment, and the integrity of offshore drilling operations, ultimately transforming it from a box-ticking exercise into a robust safety management system.

Figure 9:
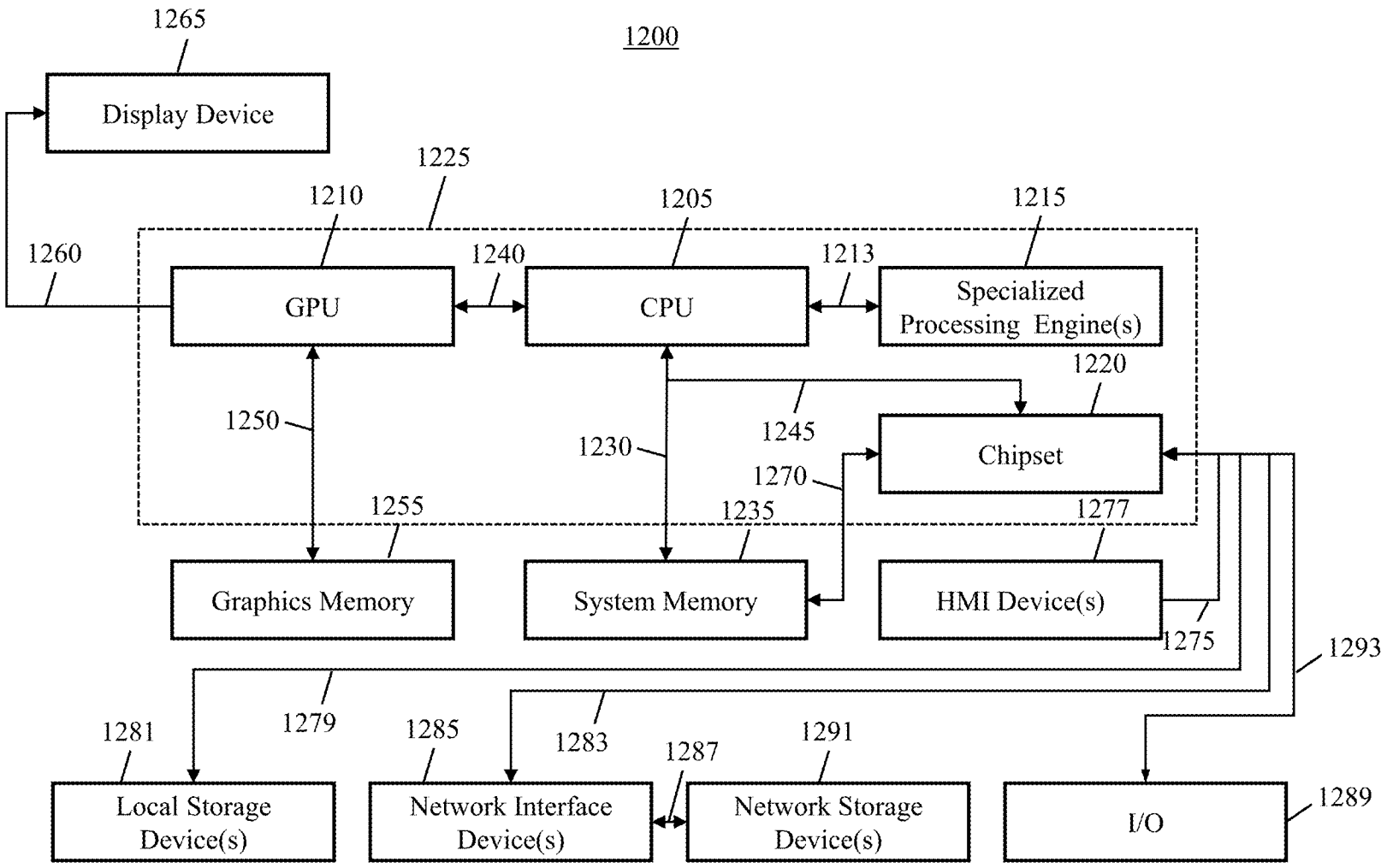
FIG. 9 shows a computing system in accordance with one or more embodiments of the present invention.

FIG. 9 shows a schematic of a computing system 1200 in accordance with one or more embodiments of the present invention. Computing system 1200 may be an independent computing system or integrated as part of another computing or control system disposed on the drilling rig. Computing system 1200 may include one or more central processing units ("CPU") 1205, one or more graphics processing units ("GPU") 1210, and one or more specialized processing engines 1215. Computing system 1200 may optionally include, if not integrated into CPU 1205, chipset 1220 that incorporates one or more functions previously provided by a legacy host bridge (not shown) or input/output ("I/O") bridge (not shown). In certain embodiments, one or more of the above-noted components may be discrete components. In other embodiments, one or more of the above-noted components, or the functions that they implement, may be integrated into a system-on-chip ("SOC") 1225. SOC 1225 may include a plurality of one or more of the above-noted components disposed on the same physical die (not shown) or disposed within the same mechanical package (not shown). One of ordinary skill in the art will recognize that the one or more CPUs 1205, GPUs 1210, specialized processing engines 1215, and chipset 1220 may be integrated, in whole or in part, to reduce the thermal design power ("TDP"), reduce power consumption, reduce chip count, reduce the mechanical footprint, and reduce the complexity of the printed circuit board ("PCB") (not shown) on which they are disposed.

Each of the one or more CPUs 1205, GPUs 1210, specialized processing engines 1215, and chipset 1220 may be a single-core (not independently illustrated) or a multi-core (not independently illustrated) device. Multi-core devices typically include a plurality of processing cores (not shown) disposed on the same physical die (not shown) or disposed within the same mechanical package (not shown) that are arranged to provide enhanced capabilities over a single-core implementation. Each of the one or more CPUs 1205 may include memory interface 1230 to system memory 1235, graphics interface 1240 to the one or more GPUs 1210, specialty interface 1213 to the one or more optional specialized processing engines 1215, and chipset interface 1245 to chipset 1220. Each of the one or more GPUs 1210 may include CPU interface 1240 to the one or more CPUs 1205, memory interface 1250 to graphics memory 1255, and display interface 1260 to display device 1265. Chipset 1220 may include chipset interface 1245 to the one or more CPUs 1205, memory interface 1270 to system memory 1235, and one or more IO interfaces to one or more IO expansion devices, including, for example, a human/machine interface ("HMI") interface 1275 to one or more HMI devices 1277, local storage interface 1279 to one or more local storage devices 1281, network interface 1283 to one or more network interface devices 1285, and other I/O interfaces 1293 to one or more other I/O devices 1289.

Each local storage device 1281 may be a solid-state memory device, a solid-state memory device array, a hard disk drive, a hard disk drive array, or any other non-transitory computer readable medium. Computing system 1200 may also include one or more network-attached storage devices 1291 that communicate with one or more network interface devices 1285 via network interface 1283. The one or more network-attached storage devices 1291 may be used in addition to, or instead of, the one or more local storage devices 1281. The one or more network-attached storage devices 1291 may be a solid-state memory device, a solid-state memory device array, a hard disk drive, a hard disk drive array, or any other non-transitory computer readable medium. The one or more network-attached storage devices 1291 may or may not be collocated with computing system 1200 and may be accessible to computing system 1200 via one or more network interfaces 1283 provided by one or more network interface devices 1285. Each network interface device 1285 may provide one or more network interfaces including, for example, Ethernet, Fibre Channel, WiMAX, Wi-Fi, Bluetooth, or any other type or kind of network connectivity and network protocol suitable for networked communications.

While computing system 1200 has been described above as a general-purpose computing device, one of ordinary skill in the art will recognize that computing system 1200 may be reduced to only those components necessary to perform the desired function or scaled up as needed to meet specific requirements. As such, any of the above-noted components, or various subsets, supersets, or combinations of functions or features thereof, may be integrated, in whole or in part, or distributed among various devices based on an application, design, or form factor in accordance with one or more embodiments of the present invention. As such, the description of computing system 1200 is merely exemplary and not intended to limit the type, kind, or configuration of components that constitute a control system suitable for performing computing operations.

In certain embodiments, computing system 1200 may be implemented as a specialized industrial system, a server, a workstation, a desktop computer, a laptop computer, a netbook, a tablet, a smartphone, a mobile device, and/or any other type or kind of control system in accordance with one or more embodiments of the present invention. In other embodiments, computing system 1200 may be instantiated as a virtual computer (not shown) in a virtual or cloud-based infrastructure such as those provided by, for example, Amazon AWS®, Microsoft Azure®, Google Cloud®, or other cloud computing service providers. In such embodiments, the components of computing system 1200 may be distributed in a manner that is transparent, but potentially unknown, to the end user. Advantageously, virtualization provides physical isolation, fault tolerance, redundancy, and automated backup mechanisms that protect the integrity of data stored therein.

One of ordinary skill in the art, having the benefit of this disclosure, will recognize that one or more non-transitory computer-readable media may comprise software instructions that, when executed by a processor, may perform one or more of the above-noted methods in accordance with one or more embodiments of the present invention.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should only be limited by the appended claims.

What is claimed is:

1. A method of compliance enforcement of safety protocols on a drilling rig comprising:

receiving, at the computing system, a pressure test procedure comprising a pressure test for one or more pressure-keeping devices under test and a specific configuration of equipment involved in the pressure test;

validating, by the computing system, the pressure test procedure by determining that the specific configuration of equipment, as implemented on the drilling rig, is capable of isolating and pressurizing the one or more pressure-keeping devices under test in accordance with the pressure test;

receiving, at the computing system, a current calibration for each of one or more pressure sensors involved in the pressure test;

validating, by the computing system, the current calibration for each of the one or more pressure sensors is within a currently valid calibration interval;

receiving, at the computing system, a current alignment for each of one or more valves required to isolate and pressurize one or more pressure-keeping devices under test in accordance with a pressure test, wherein each of the one or more valves communicates its current alignment to the computing system;

validating, by the computing system, the current alignment for each of the one or more valves is capable of isolating and pressurizing the one or more pressure-keeping devices under test in accordance with the pressure test;

providing, by the computing system, an indication that the pressure test is safe to execute based on the validation of the pressure test procedure and the current alignment for each of the one or more valves;

receiving, at the computing system, sensed pressure data from the one or more pressure sensors;

extrapolating, by the computing system, the sensed pressure data to predict an anticipated pressure value throughout a remainder of the duration of the pressure test;

predicting, by the computing system, a test result of the pressure test based on the extrapolation prior to completion of the pressure test; and reporting, by the computing system, the predicted test result of the pressure test.

2. The method of claim 1, further comprising:

installing a position sensor, rotary encoder, or other equipment on each manually actuated valve involved in the pressure test, wherein the position sensor, rotary encoder, or other equipment communicates its current alignment to the computing system.

3. The method of claim 1, further comprising:

logging, by the computing system, the sensed pressure data from the one or more pressure sensors.

4. The method of claim 1, further comprising:

determining, by the computing system, a test result based on comparing the sensed pressure data obtained during execution of the pressure test to criteria specified by the pressure test.

5. The method of claim 1, wherein extrapolating further comprises calculating, by the computing system, confidence intervals for the prediction of the anticipated pressure.

6. The method of claim 5, further comprising:

determining, by the computing system, the predicted test result is a failure; and providing, by the computing system, an indication that the pressure test being executed should be terminated early.

7. The method of claim 5, further comprising:

determining, by the computing system, the predicted test result is a pass; and providing, by the computing system, an indication that the pressure test being executed is anticipated to be a pass and may be terminated early.

8. The method of claim 1, further comprising:

generating, by the computing system, an immutable report on the pressure test comprising the pressure test procedure, the validation of the pressure test procedure, the current alignment for each of the one or more valves, the validation of the current alignment for each of the one or more valves, the sensed pressure data from execution of the pressure test, and all test results, pass or fail.

9. The method of claim 8, wherein the immutable report further comprises the current calibration for each of the one or more pressure sensors and the validation of the current calibration for each of one or more pressure sensors.

10. The method of claim 8, further comprising:

encrypting, by the computing system, the immutable report on the pressure test.

11. The method of claim 8, further comprising:

transmitting, by the computing system, the immutable report on the pressure test to a remote server over a network connection to the Internet.

12. The method of claim 8, further comprising:

replaying a previously executed pressure test.

13. The method of claim 1, wherein the specific configuration of equipment involved in the pressure test comprises one or more valves, hoses, high-pressure control systems, choke manifolds, flow diverters, annular closing systems, annular sealing systems, casing, cement, or other pressure-keeping equipment.

14. The method of claim 1, wherein the specific configuration of equipment involved in the pressure test comprises an expected alignment of the one or more valves that isolates and enables the pressurization of the one or more pressure-keeping devices under test.

15. The method of claim 1, wherein the pressure test comprises a ramp up period, a test pressure range, a settle period, a duration of time to maintain the test pressure, and an acceptable amount of decay from the test pressure over the duration of time constituting a passing test result.

16. A method of compliance enforcement of safety protocols on a drilling rig comprising:

receiving, at the computing system, a pressure test procedure comprising a pressure test for one or more pressure-keeping devices under test and a specific configuration of equipment involved in the pressure test;

validating, by the computing system, the pressure test procedure by determining that the specific configuration of equipment, as implemented on the drilling rig, is capable of isolating and pressurizing the one or more pressure-keeping devices under test in accordance with the pressure test;

receiving, at the computing system, a current calibration for each of one or more pressure sensors involved in the pressure test;

validating, by the computing system, the current calibration for each of the one or more pressure sensors is within a currently valid calibration interval;

receiving, at the computing system, a current alignment for each of one or more valves required to isolate and pressurize one or more pressure-keeping devices under test in accordance with a pressure test, wherein each of the one or more valves communicates its current alignment to the computing system;

validating, by the computing system, the current alignment for each of the one or more valves is capable of isolating and pressurizing the one or more pressure-keeping devices under test in accordance with the pressure test;

providing, by the computing system, an indication that the pressure test is safe to execute based on the validation of the pressure test procedure and the current alignment for each of the one or more valves;

receiving, at the computing system, sensed pressure data from the one or more pressure sensors; and generating, by the computing system, an immutable report on the pressure test comprising the pressure test procedure, the validation of the pressure test procedure, the current alignment for each of the one or more valves, the validation of the current alignment for each of the one or more valves, the sensed pressure data from execution of the pressure test, and all test results, pass or fail.

17. The method of claim 16, further comprising:

installing a position sensor, rotary encoder, or other equipment on each manually actuated valve involved in the pressure test, wherein the position sensor, rotary encoder, or other equipment communicates its current alignment to the computing system.

18. The method of claim 16, further comprising:

logging, by the computing system, the sensed pressure data from the one or more pressure sensors.

19. The method of claim 16, further comprising:

determining, by the computing system, a test result based on comparing the sensed pressure data obtained during execution of the pressure test to criteria specified by the pressure test.

20. The method of claim 16, further comprising:

extrapolating, by the computing system, the sensed pressure data to predict an anticipated pressure value throughout a remainder of the duration of the pressure test;

predicting, by the computing system, a test result of the pressure test based on the extrapolation prior to completion of the pressure test; and reporting, by the computing system, the predicted test result of the pressure test.

21. The method of claim 20, wherein extrapolating further comprises calculating, by the computing system, confidence intervals for the prediction of the anticipated pressure.

22. The method of claim 21, further comprising:

determining, by the computing system, the predicted test result is a failure; and providing, by the computing system, an indication that the pressure test being executed should be terminated early.

23. The method of claim 21, further comprising:

determining, by the computing system, the predicted test result is a pass; and providing, by the computing system, an indication that the pressure test being executed is anticipated to be a pass and may be terminated early.

24. The method of claim 16, wherein the immutable report further comprises the current calibration for each of the one or more pressure sensors and the validation of the current calibration for each of one or more pressure sensors.

25. The method of claim 16, further comprising:

encrypting, by the computing system, the immutable report on the pressure test.

26. The method of claim 16, further comprising:

transmitting, by the computing system, the immutable report on the pressure test to a remote server over a network connection to the Internet.

27. The method of claim 16, further comprising:

replaying a previously executed pressure test.

28. The method of claim 16, wherein the specific configuration of equipment involved in the pressure test comprises one or more valves, hoses, high-pressure control systems, choke manifolds, flow diverters, annular closing systems, annular sealing systems, casing, cement, or other pressure-keeping equipment.

29. The method of claim 16, wherein the specific configuration of equipment involved in the pressure test comprises an expected alignment of the one or more valves that isolates and enables the pressurization of the one or more pressure-keeping devices under test.

30. The method of claim 16, wherein the pressure test comprises a ramp up period, a test pressure range, a settle period, a duration of time to maintain the test pressure, and an acceptable amount of decay from the test pressure over the duration of time constituting a passing test result.

31. A method of compliance enforcement of safety protocols on a drilling rig comprising:

receiving, at the computing system, a pressure test procedure comprising a pressure test for one or more pressure-keeping devices under test and a specific configuration of equipment involved in the pressure test;

validating, by the computing system, the pressure test procedure by determining that the specific configuration of equipment, as implemented on the drilling rig, is capable of isolating and pressurizing the one or more pressure-keeping devices under test in accordance with the pressure test;

receiving, at the computing system, a current alignment for each of one or more valves required to isolate and pressurize one or more pressure-keeping devices under test in accordance with a pressure test, wherein each of the one or more valves communicates its current alignment to the computing system;

validating, by the computing system, the current alignment for each of the one or more valves is capable of isolating and pressurizing the one or more pressure-keeping devices under test in accordance with the pressure test; and providing, by the computing system, an indication that the pressure test is safe to execute based on the validation of the pressure test procedure and the current alignment for each of the one or more valves, wherein the pressure test comprises a ramp up period, a test pressure range, a settle period, a duration of time to maintain the test pressure, and an acceptable amount of decay from the test pressure over the duration of time constituting a passing test result.

32. The method of claim 31, further comprising:

installing a position sensor, rotary encoder, or other equipment on each manually actuated valve involved in the pressure test, wherein the position sensor, rotary encoder, or other equipment communicates its current alignment to the computing system.

33. The method of claim 31, further comprising:

receiving, at the computing system, a current calibration for each of one or more pressure sensors involved in the pressure test; and validating, by the computing system, the current calibration for each of the one or more pressure sensors is within a currently valid calibration interval.

34. The method of claim 33, further comprising:

receiving, at the computing system, sensed pressure data from the one or more pressure sensors.

35. The method of claim 34, further comprising:

logging, by the computing system, the sensed pressure data from the one or more pressure sensors.

36. The method of claim 34, further comprising:

determining, by the computing system, a test result based on comparing the sensed pressure data obtained during execution of the pressure test to criteria specified by the pressure test.

37. The method of claim 34, further comprising:

extrapolating, by the computing system, the sensed pressure data to predict an anticipated pressure value throughout a remainder of the duration of the pressure test;

predicting, by the computing system, a test result of the pressure test based on the extrapolation prior to completion of the pressure test; and reporting, by the computing system, the predicted test result of the pressure test.

38. The method of claim 37, wherein extrapolating further comprises calculating, by the computing system, confidence intervals for the prediction of the anticipated pressure.

39. The method of claim 38, further comprising:

determining, by the computing system, the predicted test result is a failure; and providing, by the computing system, an indication that the pressure test being executed should be terminated early.

40. The method of claim 38, further comprising:

determining, by the computing system, the predicted test result is a pass; and providing, by the computing system, an indication that the pressure test being executed is anticipated to be a pass and may be terminated early.

41. The method of claim 34, further comprising:

generating, by the computing system, an immutable report on the pressure test comprising the pressure test procedure, the validation of the pressure test procedure, the current alignment for each of the one or more valves, the validation of the current alignment for each of the one or more valves, the sensed pressure data from execution of the pressure test, and all test results, pass or fail.

42. The method of claim 41, wherein the immutable report further comprises a current calibration for each of the one or more pressure sensors and a validation of the current calibration for each of one or more pressure sensors.

43. The method of claim 41, further comprising:

encrypting, by the computing system, the immutable report on the pressure test.

44. The method of claim 41, further comprising:

transmitting, by the computing system, the immutable report on the pressure test to a remote server over a network connection to the Internet.

45. The method of claim 41, further comprising:

replaying a previously executed pressure test.

46. The method of claim 31, wherein the specific configuration of equipment involved in the pressure test comprises one or more valves, hoses, high-pressure control systems, choke manifolds, flow diverters, annular closing systems, annular sealing systems, casing, cement, or other pressure-keeping equipment.

47. The method of claim 31, wherein the specific configuration of equipment involved in the pressure test comprises an expected alignment of the one or more valves that isolates and enables the pressurization of the one or more pressure-keeping devices under test.

* * * * *